US008282807B2

(12) United States Patent
Ohmi et al.

(10) Patent No.: US 8,282,807 B2
(45) Date of Patent: Oct. 9, 2012

(54) METAL MEMBER HAVING A METAL OXIDE FILM AND METHOD OF MANUFACTURING THE SAME

(75) Inventors: Tadahiro Ohmi, Miyagi (JP); Minoru Tahara, Miyagi (JP); Yasuhiro Kawase, Fukuoka (JP)

(73) Assignees: National University Corporation Tohoku University, Sendai-shi (JP); Mitsubishi Chemical Corporation, Tokyo (JP)

( * ) Notice: Subject to any disclaimer, the term of this patent is extended or adjusted under 35 U.S.C. 154(b) by 914 days.

(21) Appl. No.: 11/966,417

(22) Filed: Dec. 28, 2007

(65) Prior Publication Data

US 2008/0164151 A1 Jul. 10, 2008

(30) Foreign Application Priority Data

Dec. 28, 2006 (JP) ..... 2006-356046
Dec. 25, 2007 (JP) ..... 2007-332059

(51) Int. Cl.
*C25D 11/06* (2006.01)
*C25D 11/18* (2006.01)

(52) U.S. Cl. ..... 205/224; 205/325; 205/326; 205/332

(58) Field of Classification Search ..... 205/325, 205/332

See application file for complete search history.

(56) References Cited

U.S. PATENT DOCUMENTS 3,767,541 A * 10/1973 Curtis ..... 205/322
5,716,511 A * 2/1998 Melody et al. ..... 205/324
6,231,993 B1 * 5/2001 Stephenson et al. ..... 428/472.1
6,368,485 B1 * 4/2002 Ue et al. ..... 205/234
6,802,951 B2 * 10/2004 Hossick-Schott ..... 205/108
7,732,056 B2 * 6/2010 Bhatnagar et al. ..... 428/472.2
2005/0218005 A1 * 10/2005 Liu et al. ..... 205/261

FOREIGN PATENT DOCUMENTS

| | | |
|---|---|---|
| JP | 5-114582 | 5/1993 |
| JP | 5-53870 | 8/1993 |
| JP | 9-69514 | 3/1997 |
| JP | 10-130884 | 5/1998 |
| JP | 11-181595 | 7/1999 |
| JP | 2004-60044 | 2/2004 |
| JP | 2005-105300 | 4/2005 |
| WO | WO 2006/134737 A1 | 12/2006 |

OTHER PUBLICATIONS

ASM International Handbook Committee, ASM Handbook, vol. 2—Properties and Selection: Nonferrous Alloys and Special-Purpose Materials, ASM International, 1990, pp. 89-90.*
U.S. Appl. No. 12/521,387, filed Jun. 26, 2009, Ohmi, et al.

* cited by examiner

*Primary Examiner* — Patrick Ryan
*Assistant Examiner* — William Leader
(74) *Attorney, Agent, or Firm* — Oblon, Spivak, McClelland, Maier & Neustadt, L.L.P.

(57) ABSTRACT

In a method of manufacturing a metal member, a metal material containing aluminum as a main component is anodized in an anodization solution having a pH of 4 to 10 and containing a nonaqueous solvent having a dielectric constant smaller than that of water and capable of dissolving water, thereby forming a nonporous amorphous aluminum oxide passivation film on a surface of the metal member. The method includes a step of controlling the viscosity of the anodization solution. In the step of controlling the viscosity, the viscosity of the anodization solution is lowered by elevating the temperature of the anodization solution above the room temperature or by adding to the anodization solution a substance having a dielectric constant smaller than that of water and a viscosity lower than that of the nonaqueous solvent.

24 Claims, 17 Drawing Sheets

300V 50℃

300V 40℃

300V 23℃

| chemicals | ε | viscosity (mPa·s) | boiling point (°C) |
|---|---|---|---|
| THF | 7.58 | 0.55 | 65 |
| acetone | 20.7 | 0.36 | 56 |
| dioxane | 2.25 | 1.37 | 101 |
| DMSO | 4.7 | 2.24 | 189 |
| DMF | 36.7 | 0.92 | 153 |
| methanol | 32.7 | 0.55 | 65 |
| ethanol | 25.8 | 1.2 | 78 |
| IPA | 18 | 2.3 | 83 |
| water | 81 | 1 | 100 |

FIG. 9

| electrolyte | additional solvent | temperature | residual current density |
|---|---|---|---|
| EG | none | 23°C | 38 μA/cm² |
| DiEG | none | 23°C | 27 μA/cm² |
| DiEG | 20%IPA | 23°C | 21 μA/cm² |
| DiEG | 50%IPA | 23°C | 24 μA/cm² |
| DiEG | 20% acetone | 23°C | 23 μA/cm² |
| DiEG | 20%DMSO | 23°C | 22 μA/cm² |
| DiEG | 20%DMF | 23°C | 25 μA/cm² |
| DiEG | 20% dioxane | 23°C | 23 μA/cm² |
| DiEG | none | 40°C | 18 μA/cm² |
| DiEG | none | 50°C | 19 μA/cm² |
| DiEG | none | 60°C | 18 μA/cm² |

FIG. 12

METAL MEMBER HAVING A METAL OXIDE FILM AND METHOD OF MANUFACTURING THE SAME

This application is based upon and claims the benefit or priority from Japanese patent application No. 2006-356046, filed on Dec. 28, 2006, and Japanese patent application No. 2007-332059, filed on Dec. 25, 2007, the disclosures of which are incorporated herein their entirety by reference.

BACKGROUND OF THE INVENTION

This invention relates to a metal member having a metal oxide film and a method of manufacturing the same and, in particular, relates to a metal member having a metal oxide film suitable for use in a manufacturing apparatus used in a manufacturing process of an electronic device such as a semiconductor device or a flat panel display device, and to a method of manufacturing the same.

As manufacturing apparatuses for use in the fields of manufacturing electronic devices such as semiconductor devices or flat panel display devices, use is made of, for example, thin-film forming vacuum apparatuses for use in chemical vapor deposition (CVD), physical vapor deposition (PVD), vacuum evaporation, sputtering, microwave-excited plasma CVD, and so on, dry etching apparatuses for use in plasma etching, reactive ion etching (RIE), recently-developed microwave-excited plasma etching, and so on (hereinafter collectively referred to as vacuum apparatuses), cleaning apparatuses, sintering apparatuses, heating apparatuses, and so on. In recent years, as structural materials of the above-mentioned apparatuses, in particular, as structural materials having surfaces brought into contact with corrosive fluids, radicals, or irradiated ions, lightweight and strong metals containing aluminum as a main component have been widely used instead of stainless steel materials. In order to realize future high-efficiency multi-kind small-quantity production, these apparatuses are required to shift to a three-dimensional cluster tool capable of carrying out a plurality of processes by the single tool, to carry out a plurality of processes by switching the kind of gas in a single process chamber, or the like. Among practical metals, aluminum belongs to a particularly base group and, therefore, aluminum or a metal containing aluminum as a main component requires a protective film formed by an appropriate surface treatment.

As a surface protective film when a metal containing aluminum as a main component is used as a structural material, there is conventionally known an anodized film (alumite) obtained by anodic oxidation or anodization in an electrolyte solution. If an acidic electrolyte solution (normally pH 2 or less) is used as the electrolyte solution, it is possible to form a smooth and uniform alumite coating film having a porous structure.

Further, the alumite coating film is corrosion-resistant and the acidic electrolyte solution is stable and easy to manage. Therefore, the alumite coating film is generally and widely used. However, the alumite coating film having a porous structure is weak against heat as a surface treatment of a structural member and thus causes cracks due to a difference in thermal expansion coefficient between the aluminum base member and the alumite coating film (Patent Document 1—Japanese Unexamined Patent Application Publication (JP-A) No. H10-130884), thereby causing generation of particles, occurrence of corrosion due to exposure of the aluminum base member, and so on.

Further, a large amount of water and so on are accumulated/adsorbed in holes of the porous structure (Patent Document 2-Japanese Examined Patent Application Publication (JP-B) No. H5-053870) and released as a large quantity of outgas components. This causes many problems such as a significant degradation in performance of a vacuum apparatus, operation failure of devices to be manufactured, occurrence of corrosion of the alumite coating film and the aluminum base member due to coexistence with various gases including a halogen gas and chemicals, and so on. Among halogen gases, particularly, a chlorine gas is used as an etching gas in processing, such as reactive ion etching (RIE), of a metal material and is also used in a cleaning process of a thin film forming apparatus or a dry etching apparatus. Therefore, it is important to achieve a metal surface treatment of an apparatus member that can ensure strong corrosion resistance against the chlorine gas.

In terms of this, there are various proposals for alumite coating films with a low increase rate of cracks caused by a high-temperature heat load as well as methods of forming the alumite coating films. For example, there is proposed a method of forming an alumite coating film with a controlled aluminum alloy composition (Patent Document 3—Japanese Unexamined Patent Application Publication (JP-A) No. H11-181595). However, this alumite coating film also has a porous structure on the surface, like the conventional one. Therefore, various problems due to water remaining in holes of the porous structure remain outstanding.

Various methods are proposed for solving the problems caused by this porous structure. For example, there are proposed a sealing treatment in which an alumite coating film with a porous structure anodized in an acidic electrolyte is immersed in boiling water or treated in pressurized steam, thereby forming aluminum hydroxide (boehmite layer) on the surface to seal the holes (Patent Document 4—Japanese Unexamined Patent Application Publication (JP-A) No. H5-114582), a sealing treatment in a solution containing a hydrate or hydrated oxide of a metal as a main component (Patent Document 5—Japanese Unexamined Patent Application Publication (JP-A) No. 2004-060044), and so on. However, water still remains in the holes of the porous structure even after the sealing treatment. The boehmite layer of aluminum hydroxide itself is also a hydrate and thus serves as a water source depending on conditions such as a pressure and a temperature. Thus, a radical solution has not yet been reached. There is also proposed a method of performing anodic oxidation of a barrier structure after forming an alumite coating film of a porous structure (Patent Document 6—Japanese Unexamined Patent Application Publication (JP-A) No. 2005-105300). However, since anodic oxidation in two steps is required, there is a problem that the manufacturing cost increases.

Besides, as a surface treatment when a metal containing aluminum as a main component is used as a structural member, use is made of a thermal spraying method that melts and sprays a powder material of a metal, an alloy, a ceramic, or a combination of the ceramic and the metal or the alloy (Patent Document 7—Japanese Unexamined Patent Application Publication (JP-A) No. H9-069514). However, the surface treatment by the thermal spraying method is still disadvantageous in the following respect. In this method, it is difficult to suppress formation of pores through which the film surface and the base member communicate with each other. Therefore, when a corrosive gas such as a halogen gas is used in an apparatus, the base member is partly corroded at portions where the metal containing aluminum as a main component is brought into contact with the corrosive gas through the pores.

SUMMARY OF THE INVENTION

That is, the alumite coating film formed by the use of the acidic electrolyte solution has the problem of remaining/ adsorbed water. By the method of performing anodic oxidation of the barrier structure after forming the alumite coating film of a porous structure, it is difficult to completely suppress the formation of voids or the formation of gas pools. By the surface treatment using the thermal spraying method, it is difficult to suppress the formation of pores. The alumite coating film has an $Al_2O_3.nH_2O$ structure containing water, Further, by OH ions produced by electrolysis of an anodization solution, the alumite coating film is etched to become porous and therefore contains a large amount of water. For example, if the alumite coating film is used in an RIE apparatus, a large amount of water is released into a chamber during etching so as to form water plasma. Since the water plasma produces OH radicals to decompose a photoresist, the selectivity between the resist and a material to be etched is considerably decreased. Therefore, the resist should be formed thick in the conventional RIE. This causes a problem of reduction in resolution. Further, a large amount of water released into the chamber causes aggregation of ions in the chamber by gas-phase reactions to generate a large amount of dust in the chamber, resulting in a reduction in yield of devices. In the RIE, etching is normally performed at 20 to 40 mTorr and, therefore, the distances between gas molecules are sufficiently large so that the gas-phase reactions do not occur and the dust cannot be generated. Actually, however, a large amount of dust is generated and adhered to a gate valve. When wafers are taken into and out of the chamber, the dust is adhered to the wafers, resulting in production of defective products. This is because the dust is generated due to the presence of water.

Generally, a heat treatment is effective in order to release the water. However, since the conventional alumite is subjected to occurrence of cracks at 140° C., it is not possible to reduce the water by the heat treatment.

In order to solve the above-mentioned problem, the present inventors found out that, when a metal containing aluminum as a main component is subjected to anodic oxidation using an anodization solution having a neutral or a nearly neutral pH value, an aluminum oxide passivation film as a nonporous amorphous film is obtained such that the amount of water released therefrom is 1E18 molecules/$cm^2$. The aluminum oxide passivation film is prevented from occurrence of cracks due to annealing and is excellent in resistance against exposure to a chlorine gas (Patent Document 8—WO2006/134737).

However, it is difficult to obtain the aluminum oxide film having an excellent quality and a greater thickness because restriction is imposed upon an ultimate voltage in anodic oxidation which leads to the limitation to the thickness of the aluminum oxide passivation film as a protective film. Specifically, the maximum thickness with an excellent quality is no more than about 0.35 μm at a reached voltage of 200 V. As a consequence, the aluminum oxide passivation film is inevitably thin. In terms of a mechanical strength and a corrosion resistance, it is desired to achieve a method capable of forming an aluminum oxide passivation film having a greater thickness.

It is therefore an object of this invention to improve a method of forming an aluminum oxide passivation film and to provide a method of manufacturing a metal member having an aluminum oxide passivation film with a sufficiently large thickness and an excellent quality.

It is another object of this invention to provide a metal member having an aluminum oxide film which is produced by the above-mentioned method.

In order to achieve the above-mentioned objects, the present inventors have assiduously studied. It is believed that the reached voltage in anodic oxidation is restricted because electrolysis of water contained in the anodization solution occurs when the voltage is increased during the process of anodic oxidation. It has been found out that, by using a main solvent having a small dielectric constant such that electrolysis of water is suppressed, an anodization voltage can be increased.

Specifically, when diethylene glycol rather than ethylene glycol is used as the main solvent of the anodization solution, a nonporous aluminum oxide passivation film of an excellent quality is obtained even at a reached voltage of 300 V.

However, if the reached voltage is increased further, a surface of the aluminum oxide film is roughened, the amount of released gas is increased, and the corrosion resistance is degraded. This is presumably because diethylene glycol has a relatively high viscosity and concentration of electric charges occurs during anodic oxidation so that a uniform film is not obtained.

In terms of the above, a method of controlling the viscosity of the anodization solution is proposed. First, as such a method, anodic oxidation was performed at a temperature higher than the room temperature. As a result, it has been found out that a uniform film was obtained. This is presumably because, by elevating the temperature, the viscosity is decreased so that electrical conduction in the anodization solution becomes uniform. As another method of controlling the viscosity, anodic oxidation was performed by the use of an anodization solution lowered in viscosity by adding, to an organic main solvent such as ethylene glycol or diethylene glycol, another nonaqueous solvent having a viscosity lower than that of the main solvent. As a result, it has been found out that a nonporous aluminum oxide passivation film having an excellent quality was obtained.

According to an aspect of the present invention, there is provided a method of manufacturing a metal member comprising: a step of anodizing a metal material containing aluminum as a main component in an anodization solution having a pH of 4 to 10 and containing a nonaqueous solvent having a dielectric constant smaller than that of water and capable of dissolving water, thereby forming a nonporous amorphous aluminum oxide passivation film on a surface of the metal material, the method comprising a step of controlling the viscosity of the anodization solution.

The step of controlling the viscosity may include a step of using the anodization solution kept at a temperature higher than the room temperature.

Preferably, the step of controlling the viscosity may include a step of using the anodization solution kept at a temperature within a range between 30° C. and 70° C.

The step of controlling the viscosity may include a step of adding, to the anodization solution, a substance having a dielectric constant smaller than that of water and a viscosity lower than that of the nonaqueous solvent.

The step of controlling the viscosity may include a step of adjusting the viscosity of the anodization solution to a range of 2 to 50 mPa·s.

Preferably, the step of controlling the viscosity may include a step of adjusting the viscosity of the anodization solution to a range of 2 to 10 mPa·s.

Preferably, the anodization solution contains an electrolyte that makes the anodization solution electrically conductive, the anodization solution having a pH of 5.5 to 8.5.

More preferably, the anodization solution contains 50 wt % or less water and has a pH of 6 to 8.

The electrolyte contains at least one kind selected from the group consisting of boric acid, phosphoric acid, organic carboxylic acid, and salts thereof.

The anodizing step includes a step of placing the metal material and a predetermined electrode in the anodization solution, a constant current step of causing a constant current to flow between the metal material and the electrode for a predetermined time, and a constant voltage step of applying a constant voltage between the metal member and the electrode for a predetermined time.

The predetermined time in the constant current step is a time required for a voltage between the metal material and the predetermined electrode to reach a predetermined level.

The predetermined time in the constant voltage step is a time required for a current between the metal material and the predetermined electrode to reach a predetermined level.

The method may further comprise a step of heat-treating the metal material at a predetermined temperature not lower than 150° C. after the anodizing step. The predetermined temperature may be not lower than 300° C.

A current density lies in a range of 0.01 to 100 mA per square centimeter in the constant current step. The current destiny lies in preferably a range of 0.1 to 10 mA per square centimeter, and more preferably, a range of 0.15 to 1.5 mA per square centimeter.

The constant voltage applied in the constant voltage step is a voltage at which electrolysis of the anodization solution does not occur.

The nonaqueous solvent contains at least one of ethylene glycol, diethylene glycol, triethylene glycol, and tetraethylene glycol.

The electrolyte preferably contains adipate.

The metal material containing aluminum as a main component contains 50 wt % or more aluminum.

The metal material containing aluminum as a main component may contain 1 to 4.5 wt % magnesium.

The metal material containing aluminum as a main component may contain 0.15 wt % or less zirconium.

The metal material containing aluminum as a main component may be a metal in which the total content of other elements than aluminum, magnesium, and zirconium is 1 wt % or less.

Preferably, the metal material containing aluminum as a main component may be a metal in which the total content of other elements than aluminum, magnesium, and zirconium is 0.01 wt % or less.

According to another aspect of the invention, there is provided a metal member formed by the method mentioned above- and having a metal oxide film formed on its surface, the metal oxide film having a thickness between 10 nm and 10 μm, the amount of water released from the film being 1 E18 molecules/cm$^2$ or less.

It is noted here that a metal containing high-purity aluminum as a main component is a metal which contains aluminum as a main component and specific elements (iron, copper, manganese, zinc, chromium) in a total content of 1% or less. The metal containing high-purity aluminum as a main component preferably includes at least one kind of metal selected from a group consisting of magnesium, titanium, and zirconium.

Anodic oxidation is carried out by the use of an anodization solution having a pH of 4 to 10 and by controlling the viscosity of the anodization solution. Thus, a metal member is obtained which has an aluminum oxide passivation film as a thick nonporous amorphous film. Further, a residual current during anodic oxidation is small. Therefore, a metal member is obtained which has an aluminum oxide passivation film as a nonporous amorhous film having an excellent quality. In addition, it is possible to shorten the time for anodic oxidation and to increase productivity.

BRIEF DESCRIPTION OF THE DRAWING

FIG. 9 is a table showing physical properties of organic solvents as a third component used in Example 3;

FIG. 12 is a table showing residual current densities under various conditions in Example 3;

DESCRIPTION OF THE EXEMPLARY EMBODIMENTS

Figure 1A:
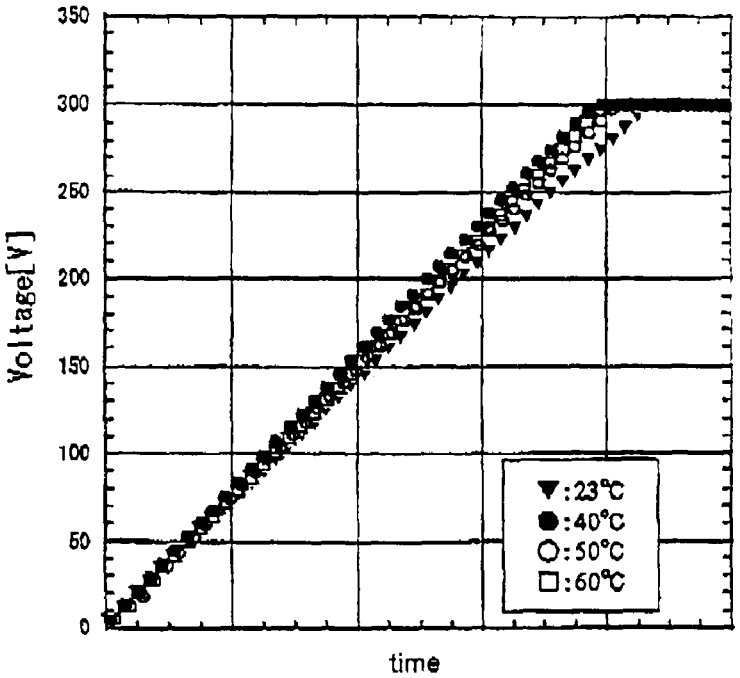
FIGS. 1A and 1B are graphs showing voltage and current characteristics with time during anodic oxidation in Example 1, respectively.

Now, this invention will be described in further detail.

A metal oxide film according to this invention is a film formed of an oxide of a metal containing aluminum or high-purity aluminum as a main component, having a thickness of 10 nm or more, and exhibiting a water release amount from the film of 1E18 molecules/cm$^2$ or less. This film exhibits high performance as a protective film when the film is formed on a base body made of a metal containing aluminum as a main component.

The thickness of the metal oxide film is preferably set to as small as 100 μm or less. If the thickness is great, cracks tend to occur and outgas tends to be released. The thickness is more preferably set to 10 μm or less, further preferably to 1 μm or less, still further preferably to 0.9 μm or less, particularly preferably to 0.8 μm or less. However, the thickness is set to 10 nm or more. If the thickness is too thin, sufficient corrosion resistance cannot be obtained. The thickness is preferably set to 20 nm or more, more preferably to 30 nm or more.

The water release amount from the metal oxide film is set to 1E18 molecules/$cm^2$ or less. If the water release amount is large, the water causes corrosion and, when the metal oxide film is used as a protective film of a structural member such as an inner wall of a vacuum apparatus or the like, the quality of a thin film to be manufactured is degraded. The water release amount is preferably set to 2E17 molecules/$cm^2$ or less, more preferably to 1E17 molecules/$cm^2$ or less. The water release amount is preferably as small as possible, but is normally 1.5E15 molecules/$cm^2$ or more.

The above-mentioned metal oxide film is a barrier-type metal oxide film which is excellent in corrosion resistance although it is a thin film and which hardly adsorbs water or the like because it has substantially no fine holes or pores.

A metal oxide film of this invention is formed of an oxide of a metal containing aluminum as a main component. The metal containing aluminum as a main component represents a metal containing 50 wt % or more aluminum. It may also be pure aluminum. This metal contains aluminum in an amount of preferably 80 wt % or more, more preferably 90 wt % or more, further preferably 94 wt % or more. The metal containing aluminum as a main component may be pure aluminum and, if necessary, may contain any desired metal that can form an alloy with aluminum and may contain two kinds or more. The kind of metal is not particularly limited, but at least one kind of metal selected from the group consisting of magnesium, titanium, and zirconium is preferable. Among them, magnesium is particularly preferable because the strength of an aluminum base body can be improved.

Further, a metal oxide film of this invention is formed of an oxide of a metal containing high-purity aluminum, which is a metal containing aluminum as a main component and which is suppressed in contents of specific elements (iron, copper, manganese, zinc, and chromium). The total content as a sum of the contents of these specific elements is preferably 1.0 wt % or less, more preferably 0.5 wt % or less, further preferably 0.3 wt % or less. The metal containing high-purity aluminum as a main component may be pure aluminum and, if necessary, may further contain any desired metal that can form an alloy with aluminum and may contain two kinds or more. The kind of metal is not particularly limited as long as it is other than the above-mentioned specific elements. Specifically, at least one kind of metal selected from the group consisting of magnesium, titanium, and zirconium is preferable. Among them, magnesium is particularly preferable because the strength of an aluminum base body can be improved. The concentration of magnesium is not particularly limited as long as within a range allowing formation of an alloy with aluminum, but, in order to achieve sufficient improvement in strength, the concentration is normally set to 0.5 wt % or more, preferably to 1.0 wt % or more, more preferably to 1.5 wt % or more. Further, in order to form a uniform solid solution with aluminum, the concentration is preferably 6.5 wt % or less, more preferably 5.0 wt % or less, further preferably 4.5 wt % or less, most preferably 3 wt % or less. Generally, the concentration is within a range between 1 and 4.5 wt %. The inclusion of magnesium has an effect of improving the mechanical strength.

The metal containing aluminum or high-purity aluminum as a main component according to this invention may contain, in addition thereto, an additional metal component as a crystal control agent. The additional metal component is not particularly limited as long as it has a sufficient effect on crystal control, but zirconium or the like is preferably used. The content of zirconium is preferably 0.15 wt % or less, more preferably 0.1 wt % or less. The inclusion of the additional metal component further improves the mechanical strength and the heat resistance.

In case where the additional metal or metals are contained, the content thereof is normally set to 0.01 wt % or more, preferably to 0.05 wt % or more, more preferably to 0.1 wt % or more with respect to the entire metal containing aluminum or high-purity aluminum as a main component. The content is limited as mentioned above so that the characteristics by the additional metal or metals are sufficiently exhibited. However, the content is normally set to 20 wt % or less, preferably to 10 wt % or less, more preferably to 6 wt % or less, particularly preferably to 4.5 wt % or less, most preferably to 3 wt % or less. In order to allow aluminum and the additional metal component to form a uniform solid solution to thereby maintain the excellent material properties, the content is preferably smaller than the above-mentioned limit.

In the metal containing aluminum or high-purity aluminum as a main component, the total content of elements excluding aluminum, magnesium, and zirconium is preferably 1 wt % or less. Further, the content of each of the elements excluding aluminum, magnesium, and zirconium is preferably 0.01 wt % or less. If the contents of these impurity elements exceed the above-mentioned value, oxygen is produced in the oxide film so that voids are formed to cause occurrence of cracks in annealing. Further, residual current of the film is increased. In particular, if the total content of the elements excluding aluminum, magnesium, and zirconium is 0.01 wt % or less, a residual current density in anodic oxidation is sufficiently low so that a dense oxide film is produced.

Next, description will be made of a method of manufacturing an oxide film of a metal member containing aluminum or high-purity aluminum as a main component according to this invention.

According to a method of anodizing a metal containing aluminum or high-purity aluminum as a main component in an anodization solution of pH 4 to 10, it is possible to obtain a dense pore-free barrier-type metal oxide film. Generally, by anodizing a base body made of the metal containing aluminum as a main component in the anodization solution of pH 4 to 10, a film made of an oxide of the metal containing aluminum as a main component is formed on the surface of the base body.

This method has a function of repairing a defect caused by nonuniformity of a substrate and is thus advantageous in that a dense and smooth oxide film can be formed. The pH of the anodization solution used in this invention is normally 4 or more, preferably 5 or more, more preferably 6 or more, and is normally 10 or less, preferably 9 or less, more preferably 8 or less. The pH is desirably close to a neutral value so that the metal oxide film formed by the anodic oxidation is not easily dissolved in the anodization solution.

The anodization solution used in this invention preferably exhibits a buffering action in the range of pH 4 to 10 in order also to maintain the pH within a predetermined range by buffering variation in concentration of various substances during the anodization. For this purpose, it is desirable to contain a compound such as an acid or a salt that exhibits the buffering action. The kind of such a compound is not particularly limited but, because of high solubility in the anodization solution and also high solution stability, at least one kind of compound selected from the group consisting of boric acid, phosphoric acid, organic carboxylic acid, and salts thereof is preferable. More preferably, the compound is the organic carboxylic acid or its salt with almost no residual boron or phosphorus element in the metal oxide film.

A solute component even in a very small amount is taken into a metal oxide film formed by anodic oxidation. If the organic carboxylic acid or its salt is used as the solute, there is no possibility at all of dissolution of the boron or phosphorus element from the metal oxide film when it is applied to a vacuum thin-film forming apparatus or the like. Therefore, stabilization and improvement in quality of a formed thin film and in performance of a device or the like using the same are expected.

Any organic carboxylic acid may be used as long as it has one or two or more carboxyl groups. Further, as long as the expected effect of this invention is not marred, the organic carboxylic acid may further have a functional group other than the carboxyl group. For example, formic acid or the like may preferably be used. In terms of high solubility in the anodization solution and also high solution stability, aliphatic carboxylic acids are preferable and, among them, an aliphatic dicarboxylic acid with a carbon number of 3 to 10 is preferable. The aliphatic dicarboxylic acid is not particularly limited but may be, for example, malonic acid, maleic acid, fumaric acid, succinic acid, tartaric acid, itaconic acid, glutaric acid, dimethylmalonic acid, citraconic acid, citric acid, adipic acid, heptane acid, pimelic acid, suberic acid, azelaic acid, sebacic acid, and so on. Among them, the tartaric acid, the citric acid, and the adipic acid are particularly preferable in terms of solution stability, safety, excellent buffering action, and so on. These acids may be used alone or in combination of two or more kinds.

The salt of boric acid, phosphoric acid, or organic carboxylic acid may be a salt of such an acid and an appropriate cation. As the cation, there is no particular limitation, but use may be made of, for example, an ammonium ion, a primary, secondary, tertiary, or quaternary alkylammonium ion, an alkali metal ion, a phosphonium ion, a sulfonium ion, or the like. Among them, the ammonium ion or the primary, secondary, tertiary, or quaternary alkylammonium ion is preferable in terms of less influence caused by residual metal ions remaining on a surface which diffuse into a substrate metal. An alkyl group of the alkylammonium ion may be appropriately selected in consideration of solubility in the anodization solution, but is normally an alkyl group with a carbon number of 1 to 4.

These compounds may be used alone or in combination of two or more kinds. Further, the anodization solution according to this invention may contain another compound in addition to the foregoing compound.

The concentration of the compound may be appropriately selected depending on the purpose, but is normally set to 0.01 wt % or more, preferably to 0.1 wt % or more, more preferably to 1 wt % or more with respect to the entire anodization solution. It is desirable to increase the concentration in order to increase the electrical conductivity and sufficiently form the metal oxide film. However, the concentration is normally set to 30 wt % or less, preferably to 15 wt % or less, more preferably to 10 wt % or less. In order to maintain high performance of the metal oxide film and to suppress the cost, it is desirable that the concentration is not greater than the above-mentioned upper limit.

The anodization solution used in this invention preferably contains a nonaqueous solvent. If the anodization solution containing a nonaqueous solvent is used, the time required for constant-current anodization is shortened as compared with an aqueous solution-based anodization solution. Thus, there is an advantage that high-throughput processing is enabled.

The kind of nonaqueous solvent is not particularly limited as long as excellent anodic oxidation can be carried out and the solubility to the solute is sufficient, but a solvent having one or more alcoholic hydroxyl groups and/or one or more phenolic hydroxyl groups or an aprotic organic solvent is preferable. Among them, the solvent having the alcoholic hydroxyl group/groups is preferable in terms of the storage stability.

As the nonaqueous solvent, an organic solvent having a dielectric constant smaller than that of water and a low vapor pressure is preferable in order to prevent decomposition of water in the anodization solution and to prevent a grown aluminum oxide film from being etched because the binding energy of a substance is inversely proportional to a square of the dielectric constant whereas the dielectric constant of water is 80. For example, ethylene glycol which has a dielectric constant of 39, diethylene glycol which has a dielectric constant of 33, triethylene glycol which has a dielectric constant of 24, or tetraethylene glycol which has a dielectric constant of 20 can be used. Therefore, by the use of these organic solvents, it is possible to effectively lower the dielectric constant and to increase the reached voltage without causing electrolysis of water. These organic solvents may be used alone or in combination. When the nonaqueous solvent is contained, water may be contained.

The content of the nonaqueous solvent with respect to the entire anodization solution is normally 10 wt % or more, preferably 30 wt % or more, further preferably 50 wt % or more, particularly preferably 55 wt % or more. On the other hand, the content of the nonaqueous solvent is normally 95 wt % or less, preferably 90 wt % or less, particularly preferably 85 wt % or less.

If the anodization solution contains water in addition to the nonaqueous solvent, the content of water with respect to the entire anodization solution is normally 1 wt % or more, preferably 5 wt % or more, further preferably 10 wt % or more, particularly preferably 15 wt % or more and, on the other hand, is normally 85 wt % or less, preferably 50 wt % or less, particularly preferably 40 wt % or less.

The ratio of water with respect to the nonaqueous solvent is normally 1 wt % or more, preferably 5 wt % or more, further preferably 7 wt % or more, particularly preferably 10 wt % or more and, on the other hand, is normally 90 wt % or less, preferably 60 wt % or less, further preferably 50 wt % or less, particularly preferably 40 wt % or less.

In this invention, no particular limitation is imposed upon an electrolytic method for anodic oxidation as long as the expected effect of this invention is not significantly marred. As a current waveform, use may be made of, for example, other than a direct current, a pulse method in which the applied voltage is periodically turned on and off, a PR method in which the polarity is reversed, an alternating current, an AC-DC superimposed current, an imperfectly-rectified current, a modulation current such as a triangular wave, or the like. Preferably, the direct current is used.

In this invention, no particular limitation is imposed on a method of controlling current and voltage of the anodic oxidation. It is possible to appropriately combine the conditions for forming the oxide film on the surface of the metal containing aluminum as a main component. Generally, anodic oxidation is preferably carried out at a constant current and at a constant voltage. That is, it is preferable that anodization be carried out at a constant current until a predetermined anodization voltage Vf is reached and, after the anodization voltage is reached, anodic oxidation be carried out with the reached anodization voltage maintained for a fixed time.

In this event, in order to efficiently form the oxide film, the current density is normally set to 0.001 mA/cm$^2$ or more, preferably to 0.01 mA/cm$^2$ or more. However, in order to obtain an oxide film with excellent surface flatness, the current density is normally set to 100 mA/cm$^2$ or less, and preferably to 10 mA/cm$^2$ or less.

Further, the anodization voltage Vf is normally set to 3V or more, preferably to 10V or more, more preferably to 20V or more. Since the thickness of the oxide film to be obtained is related to the anodization voltage Vf, it is preferable to apply the voltage no less than the above-mentioned lower limit in order to give a certain thickness to the oxide film. However, it is normally set to 1000V or less, preferably to 700V or less, more preferably to 500V or less. Since the oxide film to be obtained is highly insulative, it is preferable to perform the anodic oxidation at a voltage not higher than the above-mentioned upper limit in order to form the high-quality oxide film without causing dielectric breakdown.

In order to increase the thickness of the oxide film, the anodization voltage must be increased. In this event, the reached voltage depends upon the kind of the anodization solution. When diethylene glycol is used as a main solvent, the reached voltage is elevated as compared with the case where ethylene glycol is used as a main solvent. In case of ethylene glycol, the reached voltage required to obtain a high-quality aluminum oxide film is 200 V and the thickness of the film at that voltage is about 0.35 μm. On the other hand, in case of diethylene glycol, the reached voltage can be elevated to 300 V and a high-quality aluminum oxide film having a thickness of 0.45 μm can be formed.

Use may be made of a method in which an AC power supply with a constant peak current value is used instead of a DC power supply until an anodization voltage is reached and, when the anodization voltage is reached, the AC power supply is switched into a DC power supply the voltage of which is held for a fixed time.

In this invention, organic solvents such as ethylenglycol, diethylene glycol, triethylene glycol, tetraethylene glycol, and so on are used alone or in combination. The anodization temperature is important in formation of a high-quality aluminum oxide film. Generally, the anodization temperature is preferably higher than the room temperature, more preferably within the range between 30° C. and 70° C.

According to another embodiment of this invention, the anodization solution not only contains a main solvent but also another nonaqueous solvent or solvents having a dielectric constant smaller than that of water and a viscosity smaller than that of the main solvent. For example, use may be made of isopropylalcohol (IPA), acetone, dimethylsulfoxide (DMSO), N,N-dimethylformamide (DMF), dioxane, and so on which have a viscosity lower than that of the main solvent. The ratio of such solvent with respect to the main solvent is preferably 5 wt % or more, further preferably 10 wt % or more, particularly preferably 15 wt % or more and is normally 50 wt % or less, preferably 40 wt % or less, further preferably 35 wt % or less, particularly preferably 30 wt % or less.

The organic solvent having an anodization temperature higher than the room temperature and/or a viscosity lower than that of the main solvent serves to lower the viscosity of the anodization solution, to impart uniformity as a whole of the anodization solution, and to provide uniform electrical conductivity to the anodization solution. As a consequence, anodization can be carried out at a higher anodization voltage so that the thickness of the film can be increased. In addition, a high-quality uniform oxide film is obtained.

The viscosity of the anodization solution thus controlled is desirably 2-50 mPa·s, more preferably 2-10 mPa·s.

To the anodization solution, an electrolyte that makes the anodization solution electrically conductive is added. However, if the anodization solution becomes acidic as a result of addition of the electrolyte, the aluminum member is corroded. In view of the above, use is made of an electrolyte, for example, adipate, such that the electrical conductivity of the anodization solution is increased and that the anodization solution has a pH 4 to 10, preferably 5.5 to 8.5, more preferably 6 to 8, so as to prevent corrosion of aluminum. The content of the electrolyte is 0.1 to 10 wt %, preferably about 1%. In a typical example, use is made of an anodization solution containing 79% organic solvent, 20% water, and 1% electrolyte. More preferably, the anodization solution contains 50 wt % or less water and has a pH 6 to 8.

The anodic oxidation preferably includes a first step of placing a piece of the metal and a counter electrode (e.g. platinum) in the anodization solution, a second step of applying a positive potential to the metal and a negative potential to the counter electrode to cause a constant current to flow for a predetermined time, and a third step of applying a constant voltage between the metal and the counter electrode for a predetermined time. The predetermined time in the second step is preferably a time required for a voltage difference between the metal and the counter electrode to reach a predetermined value (e.g. 300V when diethylene glycol is used).

The predetermined time in the third step is preferably a time required for a current between the metal and the counter electrode to reach a predetermined value. The current value rapidly decreases when the voltage reaches the predetermined value mentioned above, and then gradually decreases with time. As this residual current is smaller, the quality of the oxide film is improved. For example, if the constant-voltage processing is carried out for 24 hours, the film quality is equivalent to that obtained through a heat treatment. In order to increase the productivity, it is necessary to finish the constant-voltage processing after lapse of an appropriate time and carry out a heat treatment (annealing). The heat treatment is preferably carried out at about 150° C. to 300° C. for 0.5 to 1 hour.

In the second step, a current of 0.01 to 100 mA, preferably 0.1 to 10 mA, more preferably 0.15 to 1.5 mA is caused to flow per square centimeter.

As described above, in the third step, the voltage is set to a value such that electrolysis of the anodization solution is not caused. The thickness of the nonporous amorphous aluminum oxide passivation film depends on the voltage in the third step.

Although not adhering to any theories, it is believed that the high-quality uniform oxide film is obtained because the pore-free metal oxide film formed in the anodization has the amorphous structure in its entirety and has almost no crystal grain boundaries or the like. It is presumed that, by further adding the compound having the buffering action and using the nonaqueous solvent as the solvent, a very small quantity of carbon component is trapped into the metal oxide film to weaken the Al—O binding strength, thereby stabilizing the amorphous structure of the entire film.

The metal oxide film thus manufactured may be heat-treated for the purpose of removing water in the film, or the like. The conventional metal oxide film having the porous structure may be subjected to occurrence of fractures or cracks even in annealing at about 150 to 200° C. and thus cannot be heat-treated at high temperature. Therefore, sufficient water removal cannot be carried out and the outgas release amount cannot be reduced. On the other hand, the metal oxide film according to this invention is the dense pore-free barrier-type film and, therefore, is advantageous in that occurrence of fractures, cracks, or the like in annealing can be suppressed and the amount of outgas released from the film can be reduced.

Particularly, a coating film of an oxide of a metal containing high-purity aluminum as a main component with almost no amount of the above-mentioned specific elements contained therein is higher in thermal stability as compared with a metal oxide coating film containing an aluminum alloy as a main component, and is hardly subjected to formation of voids, gas pools, or the like. Therefore, voids or seams hardly occur in the metal oxide film even in annealing at about 300° C. or more. Therefore, it is possible to suppress generation of particles and corrosion by chemicals or halogen gases, particularly a chlorine gas, due to exposure of the aluminum base body. In addition, the amount of outgas released from the film is smaller.

A heat treatment method is not particularly limited, but annealing in a heating furnace or the like is simple and preferable.

The temperature of the heat treatment is not particularly limited as long as the expected effect of this invention is not marred, but it is normally 100° C. or more, preferably 150° C. or more, more preferably 300° C. or more. In order to sufficiently remove water on the surface of and inside the metal oxide film by the heat treatment, it is preferable to perform the treatment at the temperature not lower than the above-mentioned lower limit. However, the temperature of the heat treatment is normally 600° C. or less, preferably 550° C. or less, more preferably 500° C. or less. It is preferable to perform the treatment at the temperature not higher than the above-mentioned upper limit in order to hold the amorphous structure of the metal oxide film and maintain the flatness of the surface. In case of annealing, the set temperature of a heating furnace is normally regarded as a heat treatment temperature.

The time of the heat treatment is not particularly limited as long as the expected effect of this invention is not marred, and may be appropriately set in consideration of the intended effect, the surface roughness due to the heat treatment, the productivity, and so on. The time of the heat treatment is normally 1 minute or more, preferably 5 minutes or more, particularly preferably 15 minutes or more. In order to sufficiently remove water on the surface of and inside the metal oxide film, it is preferable to perform the heat treatment for the time not less than the above-mentioned upper limit. However, the time of the heat treatment is normally 180 minutes or less, preferably 120 minutes or less, more preferably 60 minutes or less. It is preferable to perform the heat treatment for the time not more than the abovementioned lower limit in order to maintain the metal oxide film structure and the surface flatness.

A gas atmosphere in the furnace during the annealing is not particularly limited as long as the expected effect of this invention is not marred. Normally, nitrogen, oxygen, a mixed gas thereof, or the like may appropriately be used. In particular, an atmosphere with an oxygen concentration of 18 vol % or more is preferable, more preferably 20 vol % or more, most preferably 100 vol %.

Next, description will be made of a laminate member or metal member including a metal containing aluminum or high-purity aluminum as a main component and a film formed of an oxide of the metal and of intended uses.

A laminate member comprising a base body formed of a metal containing aluminum or high-purity aluminum as a main component and a metal oxide film of this invention formed on the base body to serve as a protective film exhibits excellent corrosion resistance against chemicals and halogen gases, particularly a chlorine gas. Even if the laminate member is heated, cracks hardly occur in the metal oxide film. Therefore, it is possible to sufficiently remove water in the film by annealing or the like and thus to suppress release of outgas from the film. Normally, corrosion of aluminum by a chlorine gas requires three factors, i.e. an oxidizer, chlorine ions, and water. Since the chlorine gas itself is an oxidizer and can be a source of chlorine ions, corrosion is caused in presence of water. However, the metal oxide film of this invention releases only an extremely small amount of water as outgas. It is therefore possible to suppress the corrosion of aluminum. Further, it is possible to suppress generation of particles due to cracks and corrosion due to exposure of the aluminum base body at cracked portions.

As described above, the metal oxide film according to this invention is resistant against gases such as a chlorine gas and chemicals, hardly suffers occurrence of cracks or the like due to heating, and releases only a very small amount of outgas. Therefore, the metal oxide film according to this invention is highly suitable as a coating film for protecting a structural member of an apparatus for manufacturing a semiconductor or a flat panel display. Further, the laminate member comprising the base body made of an aluminum-based metal and the above-mentioned metal oxide film formed on the base body is suitable as a structural member of an apparatus for manufacturing a semiconductor or a flat panel display. Herein, the apparatus for manufacturing a semiconductor or a flat panel display represents a manufacturing apparatus for use in the field of manufacturing a semiconductor or a flat panel display or the like, i.e. a vacuum thin-film forming apparatus for use in chemical vapor deposition (CVD), physical vapor deposition (PVD), vacuum deposition, sputtering, microwave-excited plasma CVD, or the like, or a dry etching apparatus for use in plasma etching, reactive ion etching (RIE), recently-developed microwave-excited plasma etching, or the like.

Prior to description of specific examples, description will be made of conditions for realizing a higher anodization voltage in order to obtain a greater thickness of the film. The organic solvent having an anodization temperature higher than the room temperature and/or a viscosity lower than that of the main solvent serves to lower the viscosity of the anodization solution and to impart uniformity to the anodization solution as a whole. Therefore, uniform electrical conduction is achieved throughout the anodization solution in its entirety. As a consequence, a higher anodization voltage can be realized. FIG. 9 shows an additional solvent lower in dielectric constant and viscosity than the main solvent and regarded as a third component.

Figure 13:
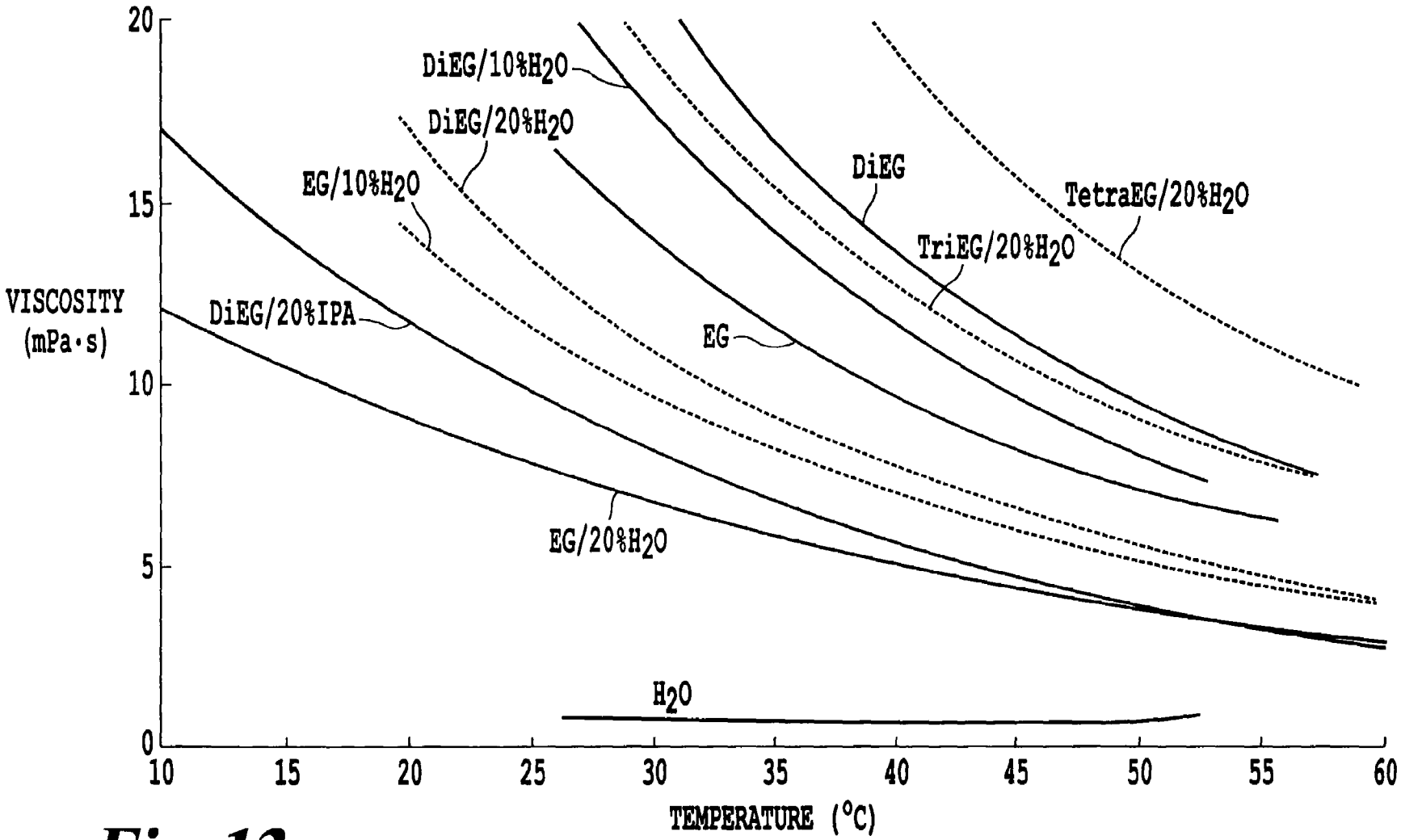
FIG. 13 is a graph showing the relationship between a viscosity and a temperature of an anodization solution with a type of a solvent as a parameter.
Figure 14:
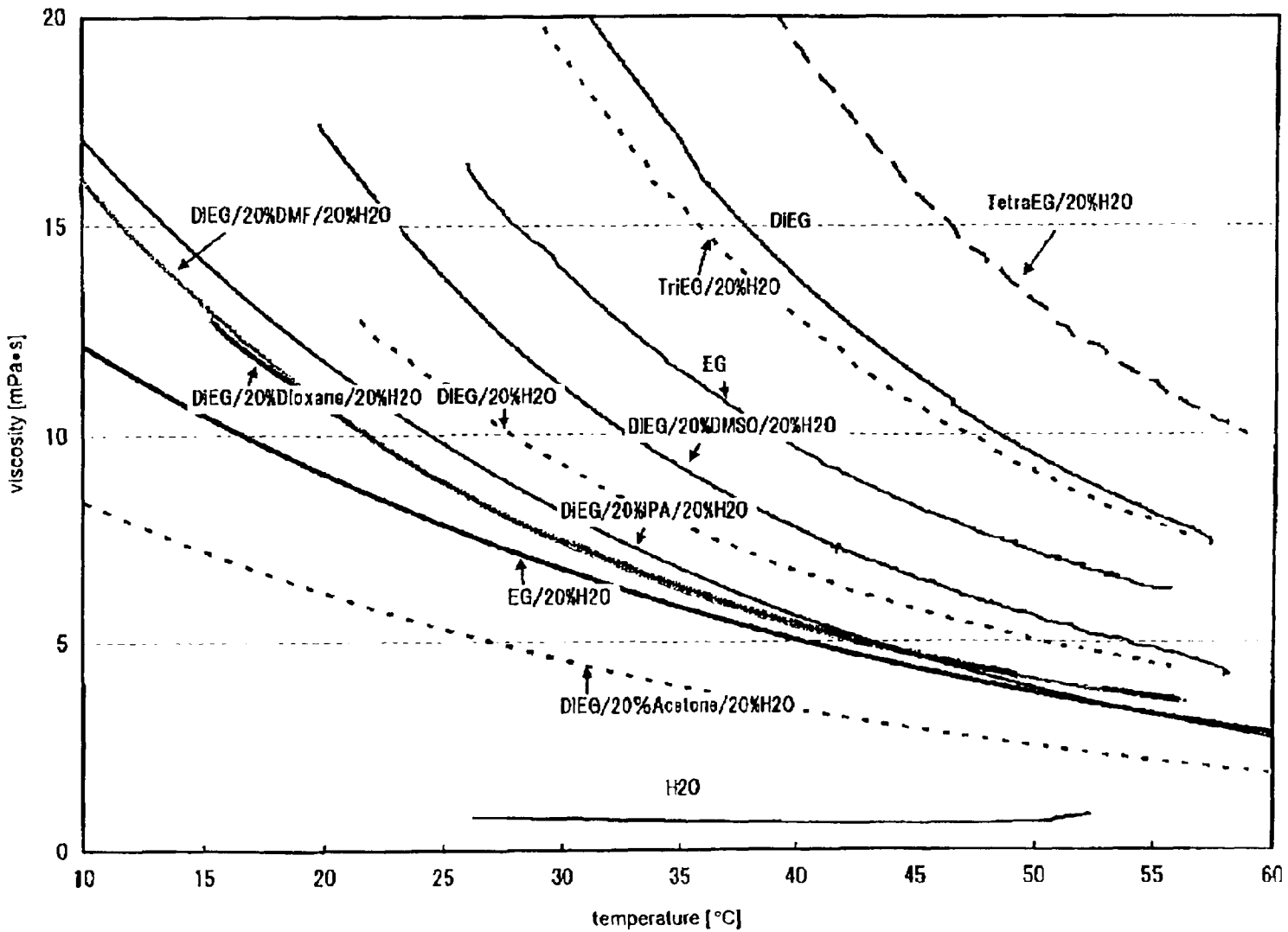
FIG. 14 is another graph showing the relationship between a viscosity and a temperature of an anodization solution with a type of a solvent as a parameter.

FIGS. 13 and 14 show the relationships between the temperature and the viscosity of the anodization solution (electrolyte solution) with the type of the anodization solution used as a parameter.

FIG. 13 at first shows the relationship between the temperature and the viscosity of the anodization solution (electrolyte solution) when ethylene glycol (EG) and diethylene glycol (DEG) are used as solvents. It is seen that the viscosity of the anodization solution is lowered as the temperature is higher. It is also understood that ethylene glycol is lower in viscosity at each temperature as compared with diethylene glycol.

Second, FIG. 13 also shows the data when 10% or 20% water is added to ethylene glycol (EG), diethylene glycol (DiEG), triethylene glycol (TriEG), tetraethylene glycol (TetraEG), respectively. These are indicated by EG/10% $H_2O$, EG/20% $H_2O$, DiEG/10% $H_2O$, DiEG/20% $H_2O$, TriEG/20% $H_2O$, and TetraEG/20% $H_2O$, respectively. It is understood that the viscosity is lowered when water is added and that, when 20 wt % water is added, the viscosity is lower than that when 10 wt % water is added. In place of water, it can be seen that addition of IPA has a greater effect on lowering viscosity of anodization solution as indicated by DiEG/20% IPA.

FIG. 14 shows characteristics when ethylene glycol (EG), diethylene glycol (DiEG), triethyleneglycol (TriEG), and tetraethylene glycol (TetraEG) are used as main solvents, IPA, DMSO, or acetone is added as a second solvent, and water is added as a third solvent. For convenience of comparison, FIG. 14 shows a part of the data in FIG. 13. From the figure, it is understood that, by adding the second solvent and the third solvent having a viscosity lower than that of the main solvent, the viscosity of the anodization solution as a whole is lowered. At a temperature higher than the room temperature, the viscosity is further lowered.

EXAMPLES

Example 1

Next, description will be made of anodic oxidation when diethylene glycol (DiEG) was used as a nonaqueous solvent. As an aluminum alloy, use was made of a high-purity aluminum alloy (S2M) containing 20 wt % Mg, 0.1 wt % Zr, and specific elements including Fe, Co, Mn, Zn, and Cr of in total content of 0.005 wt %, and balance Al. The anodization solution was prepared by the use of ammonium adipate as a solute and diethylene glycol as a main solvent and adjusted to have a pH 7.0. By the use of the anodization solution, anodic oxidation was performed.

Figure 1B:
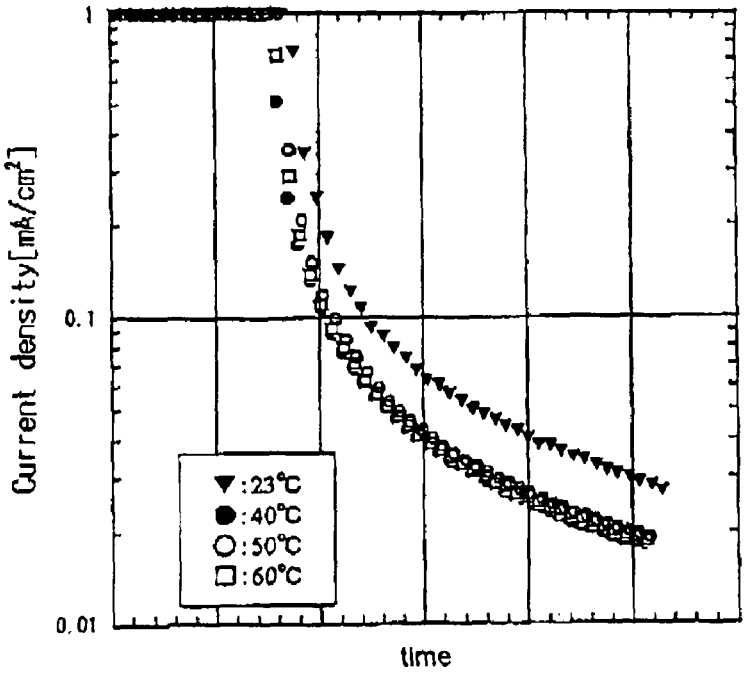

FIGS. 1A and 1B show voltage and current characteristics with time during the anodic oxidation. At a current density of 1 mA/cm$^2$, constant-current anodic oxidation was performed until the anodization voltage reached 300 V (FIG. 1A). Then, constant-voltage anodic oxidation was performed with the anodization voltage kept at the above-mentioned reached voltage (FIG. 1B). The graphs in the figures show the voltage (FIG. 1A) and the current (FIG. 1B) characteristics in the anodic oxidation. As the parameter, the temperature of the anodization solution is changed to 23° C., 40° C., 50° C., and 60° C. From the figure, it is understood that, when the temperature is higher than 23° C., i.e., when the viscosity is lower, the anodization voltage of 300 V is reached in a shorter time in the constant-current mode and the current density is reduced more quickly and has a lower value in the constant-voltage mode. As the current density is lower, the film is denser.

Figure 2:
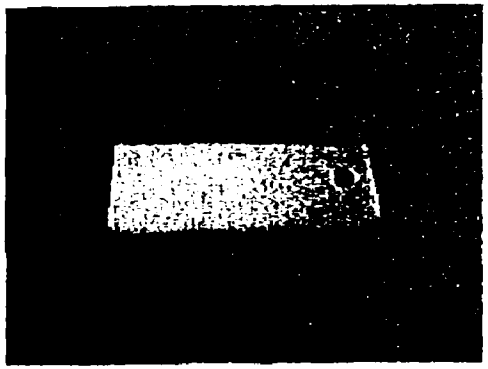
FIG. 2 shows surface conditions of metal oxide films of metal members manufactured in Example 1.
Figure 2:
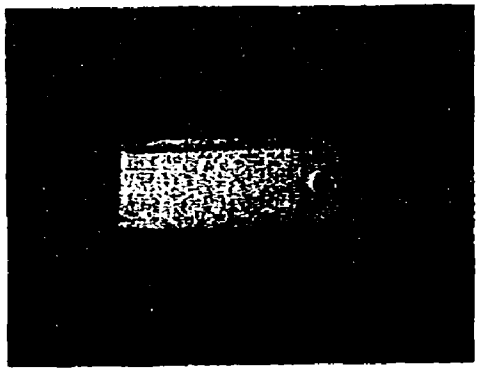
Figure 2:
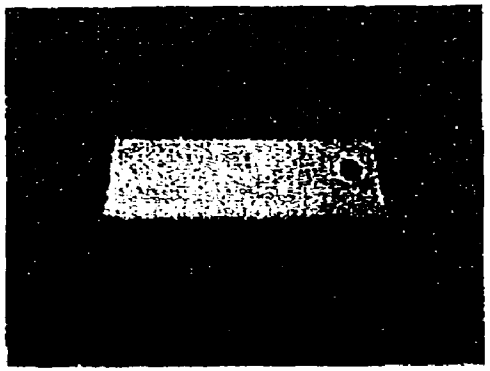
Figure 3:
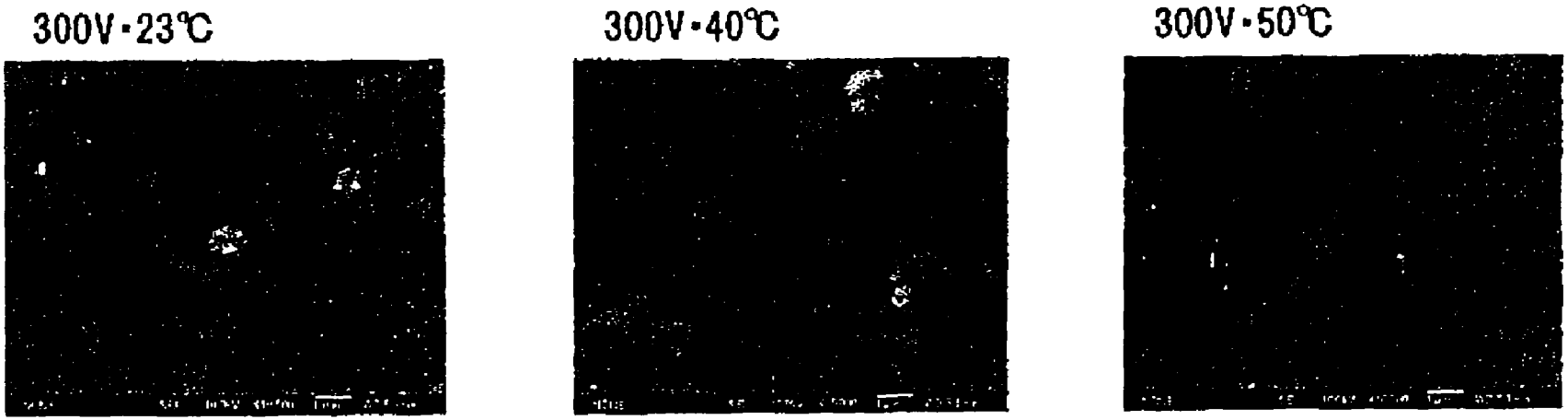
FIG. 3 shows surfaces of the metal oxide films of the metal members manufactured in Example 1 as observed by a scanning electron microscope.

FIG. 2 shows surface conditions of aluminum oxide films as metal oxide films obtained as mentioned above and annealed. As the temperature of the anodization solution is higher, the surface conditions tend to be increased in luster and uniformity, i.e., higher in flatness. The metal oxide films obtained at 23° C., 40° C., and 50° C. have the same thickness of 0.45 μm because the voltage levels are same. FIG. 3 shows surfaces of the metal oxide films after annealing as observed by a scanning electron microscope. The aluminum oxide film formed at a higher temperature exhibits a better surface condition.

Example 2

Figure 4:
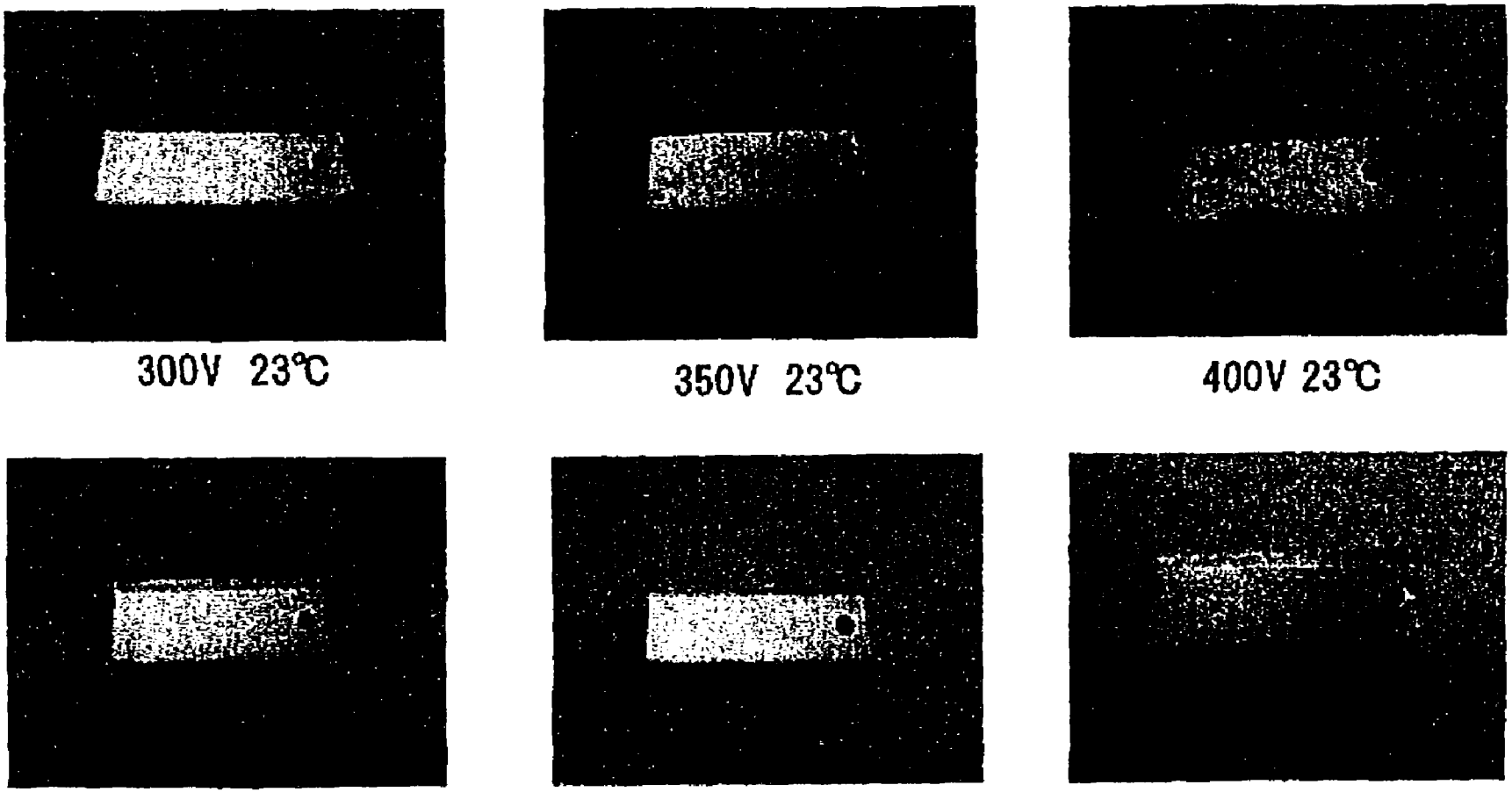
FIG. 4 shows surface conditions of metal oxide films of metal members manufactured in Example 2.

The aluminum alloy and the solute, the main solvent, and pH of the anodization solution are same as those in Example 1. At the anodization temperature of 23° C., anodic oxidation was performed at the anodization voltage of 300 V, 350 V, and 400 V. The surface conditions of the aluminum oxide films thus obtained were observed. Further, at the anodization temperature of 40° C., anodic oxidation was performed at the anodization voltage of 300 V, 350 V, and 400 V. The surface conditions of the aluminum oxide films thus obtained were observed. The surface conditions of the former and the latter are shown in an upper half and a lower half in FIG. 4, respectively. When the temperature of the anodization solution is elevated, the surface conditions exhibit bright surfaces even if the anodization voltage is increased. The aluminum oxide film obtained at 400 V and 40° C. and having brightness had a thickness of 0.6 μm. At 350 V and 300 V, the thickness was 0.53 μm and 0.45 μm, respectively. It is understood that, according to this invention, anodic oxidation at a higher voltage is possible and, consequently, the thickness of the film is greater.

Figure 5:
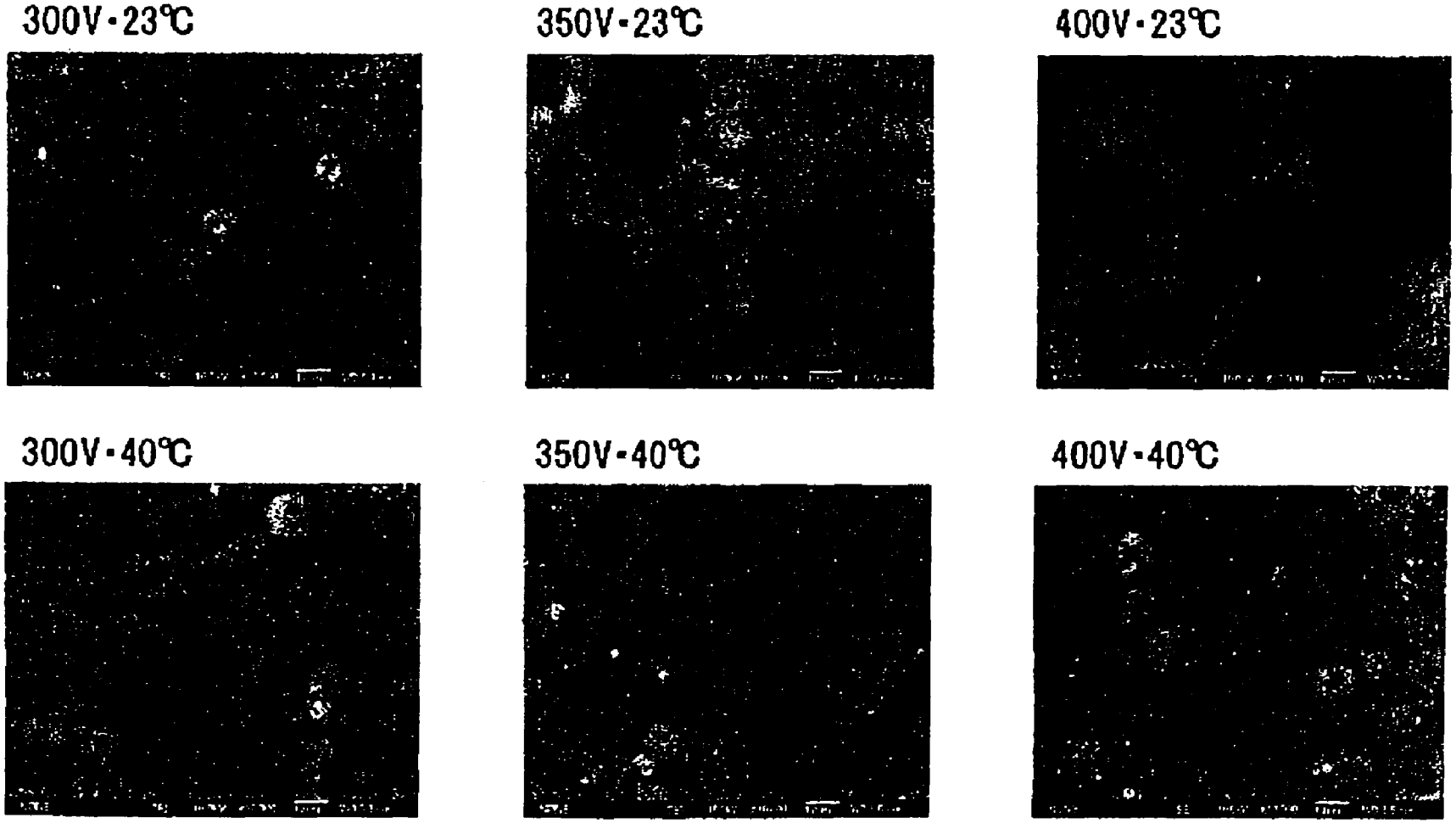
FIG. 5 shows surfaces of the metal oxide films of the metal members manufactured in Example 2 as observed by a scanning electron microscope.

FIG. 5 shows surfaces of the aluminum oxide films after annealing as observed by a scanning electron microscope. The aluminum oxide films formed at a higher temperature exhibits a better surface condition.

Figure 6:
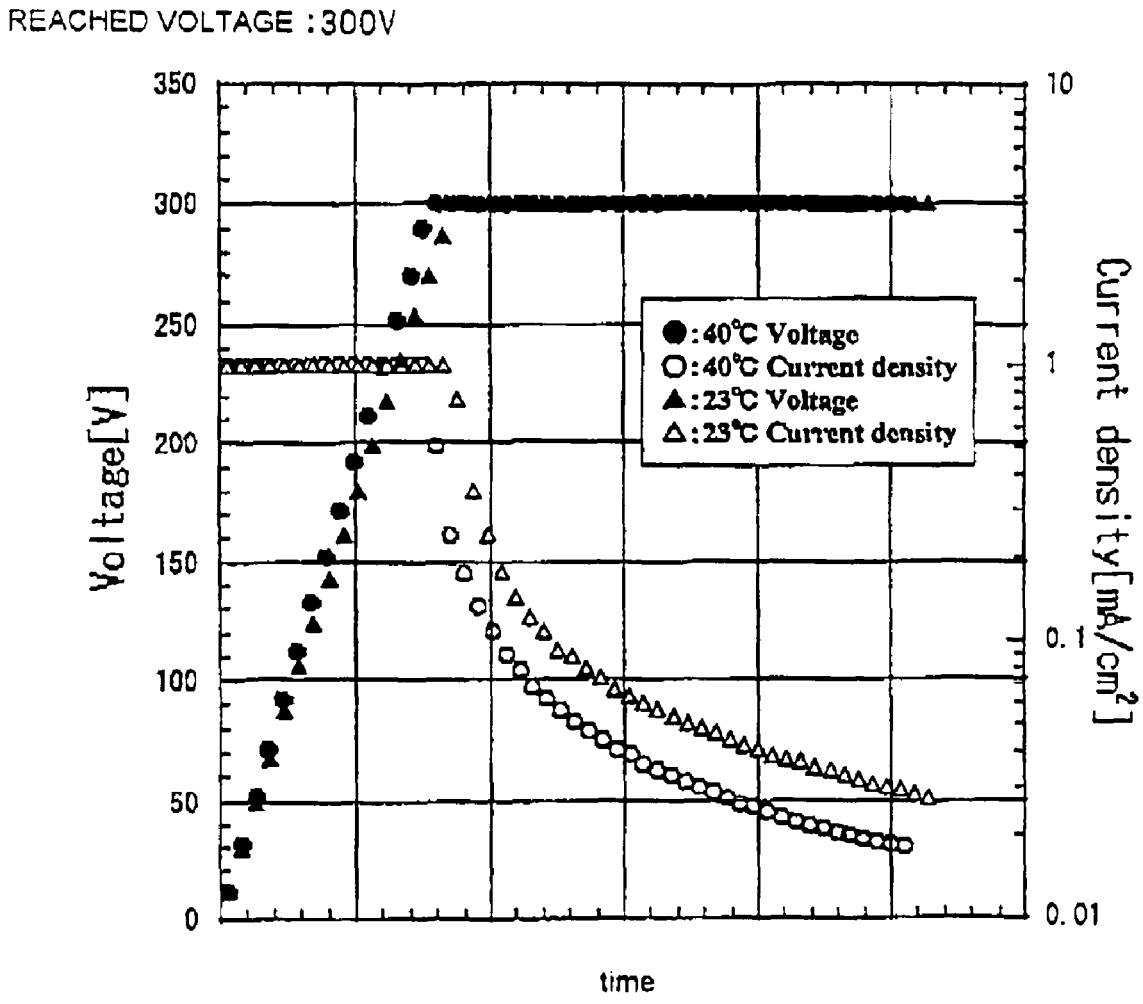
FIG. 6 is a graph showing voltage and current characteristics with time when anodic oxidation is carried out at a reached voltage of 300 V in Example 2.
Figure 7:
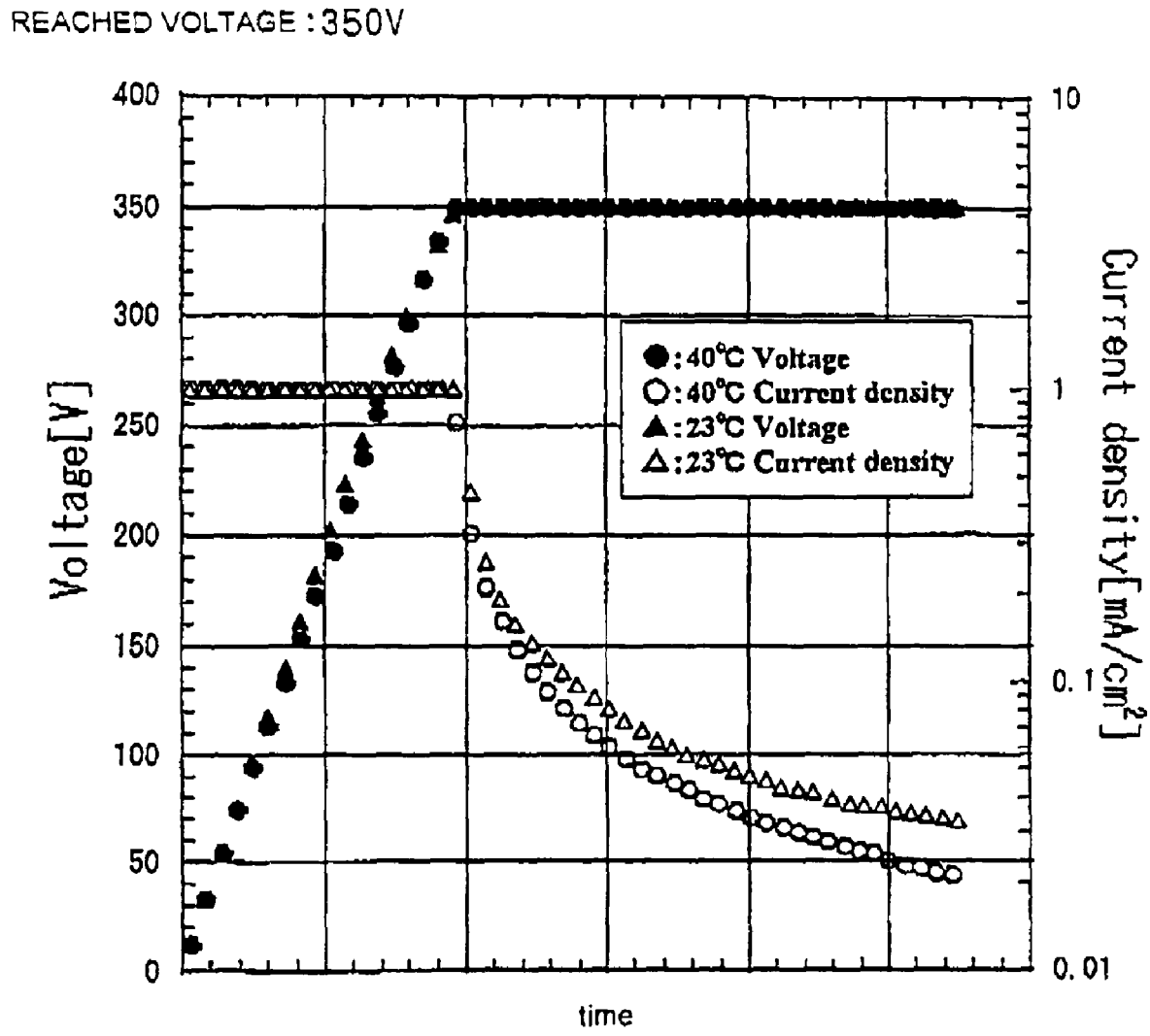
FIG. 7 is a graph showing voltage and current characteristics with time when anodic oxidation is carried out at a reached voltage of 350 V in Example 2.
Figure 8:
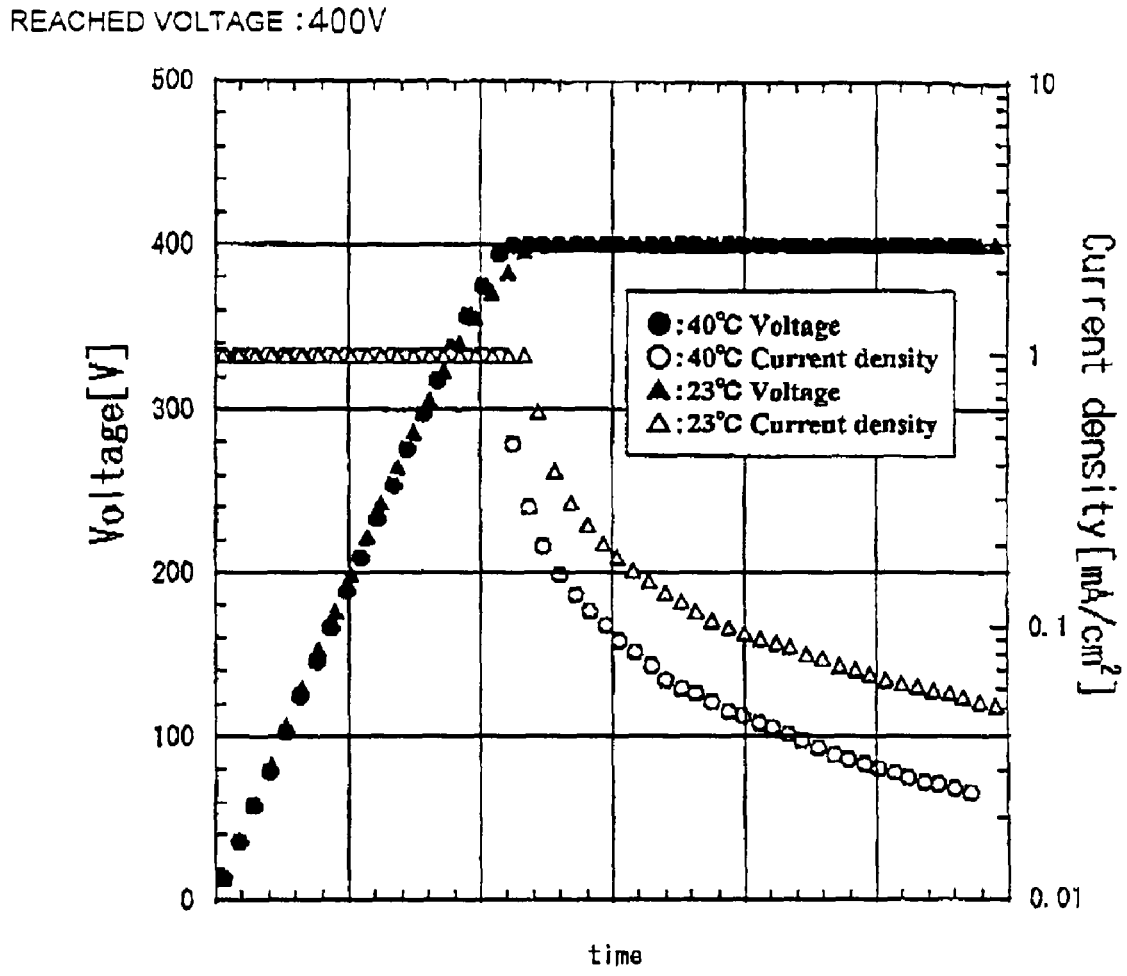
FIG. 8 is a graph showing voltage and current characteristics with time when anodic oxidation is carried out at a reached voltage of 400 V in Example 2.

FIGS. 6, 7, and 8 show the voltage and the current characteristics with time when the aluminum oxide film was formed in Example 2 at the reached voltages of 300 V, 350 V, and 400 V, respectively. In each figure, a left vertical axis shows a voltage level while a right vertical axis shows a current density.

Referring to FIG. 8, at the reached voltage of 400 V, the voltage characteristic when anodic oxidation is performed in the constant current mode can not keep the linearity and a curve appears at the anodization temperature of 23° C. At the anodization temperature of 40° C., excellent linearity is obtained. The residual current density is smaller at 40° C. This supports that the dense film is obtained.

Figure 15:
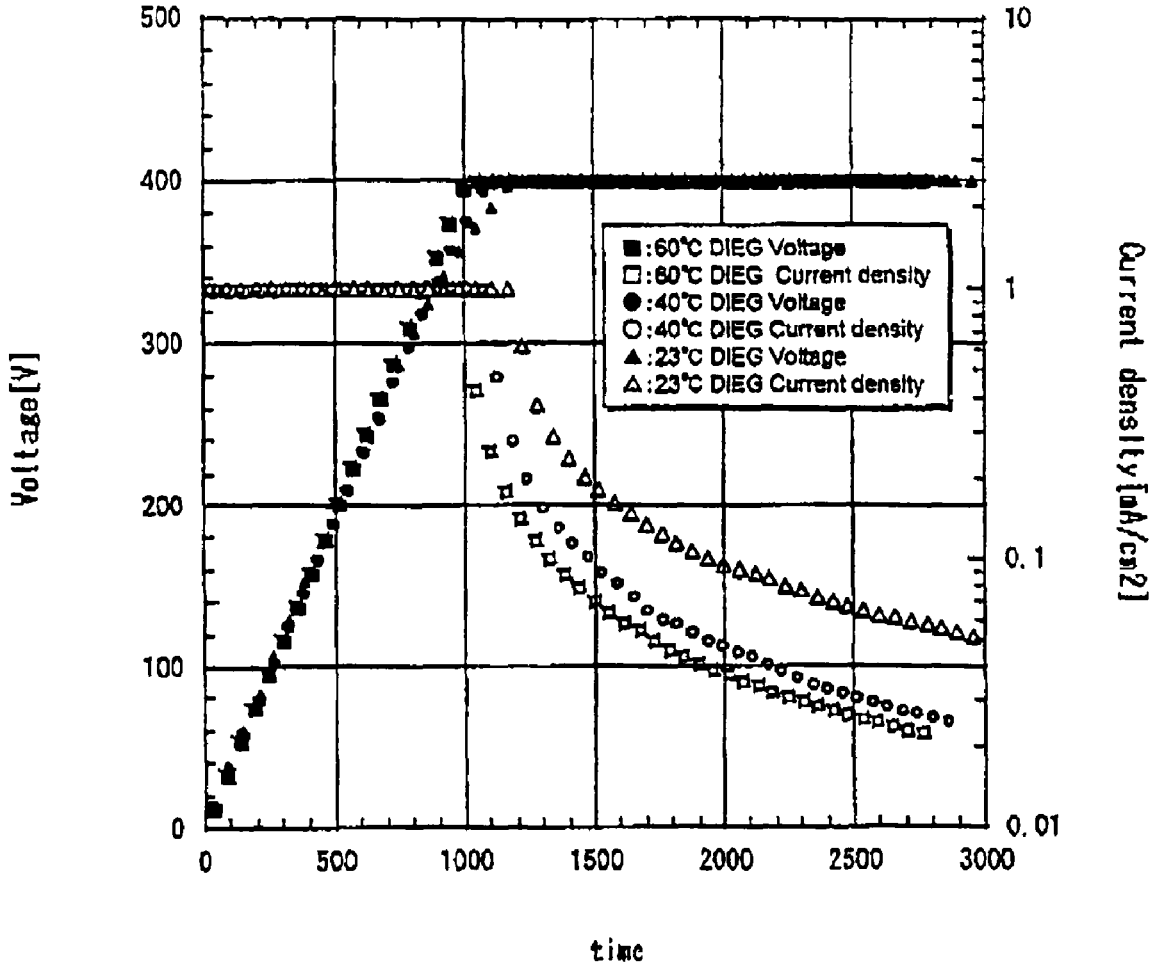
FIG. 15 is another graph showing voltage and current characteristics with time when anodic oxidation is carried out at a reached voltage of 400 V in Example 2.

FIG. 15 shows the voltage and the current characteristics with time when anodic oxidation was performed at the reached voltage of 400 V with the anodization solution kept at a temperature of 60° C., in comparison with the cases where anodic oxidation was performed at 23° C. and 40° C. From the figure, it is understood that, at the temperature of 40° C. and 60° C., i.e., at a lower viscosity, 400 V is reached in a shorter time in the constant current mode and the current density is more quickly reduced and has a lower value in the constant voltage mode.

Example 3

In Examples 1 and 2, diethylene glycol is used as the main solvent. In Example 3, in order to control the viscosity of the anodization solution, a second component was added to diethylene glycol and water. By the use of the anodization solution adjusted in viscosity, anodic oxidation was performed.

FIG. 9 shows physical properties of organic solvents as the second component, including the viscosity, the dielectric constant, and so on.

Figure 10:
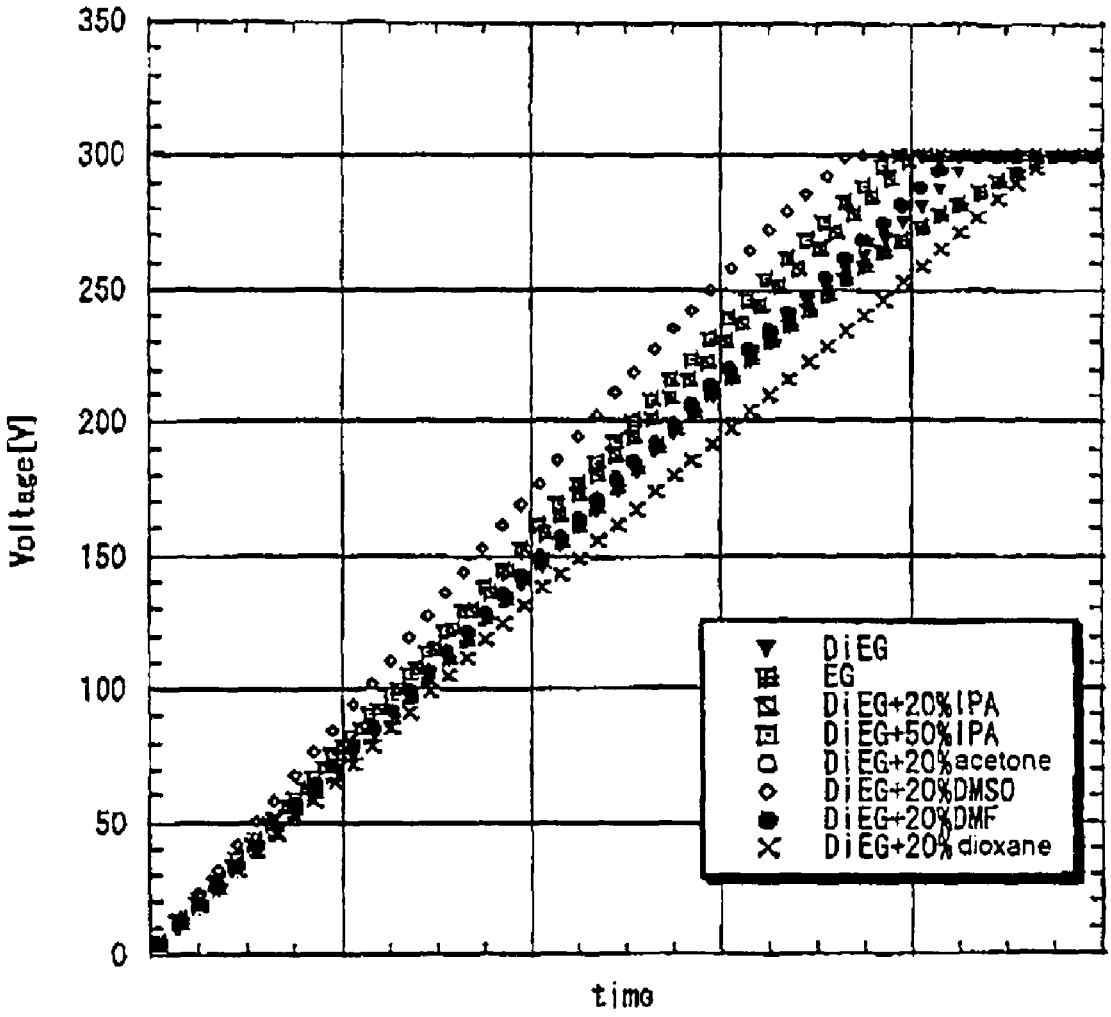
FIG. 10 is a graph showing a voltage characteristic with time in anodic oxidation in Example 3.

FIG. 10 shows a voltage characteristic representing the relationship between the voltage and the time when the aluminum oxide film was formed by anodic oxidation using various kinds of anodization solutions containing diethylene glycol (Di-EG) with isopropyl alcohol (IPA), acetone, dimethylsulfoxide (DMSO), N,N-dimethylformamide (DMF), and dioxane added thereto, respectively. The ratio of the second component with respect to diethylene glycol is shown in the figure. This figure also shows the case where the second component is not added to diethylene glycol (Di-EG). From FIG. 10, it is understood that, in case of ethylene glycol and diethylene glycol without the second component, a slope up to 300 V is deviated from linearity and that, in case where the organic solvent as the second component is contained, the linearity is excellent. Deviation from the linearity with the lapse of time suggests a poor film quality. Thus, from the figure, it is understood that an excellent film quality is obtained by adding, as the second component, the organic solvent having a low viscosity to diethylene glycol. From the figure, it is also understood that, when diethylene glycol is used as the main solvent rather than ethylene glycol, the linearity is excellent and the resultant film is dense.

Figure 11:
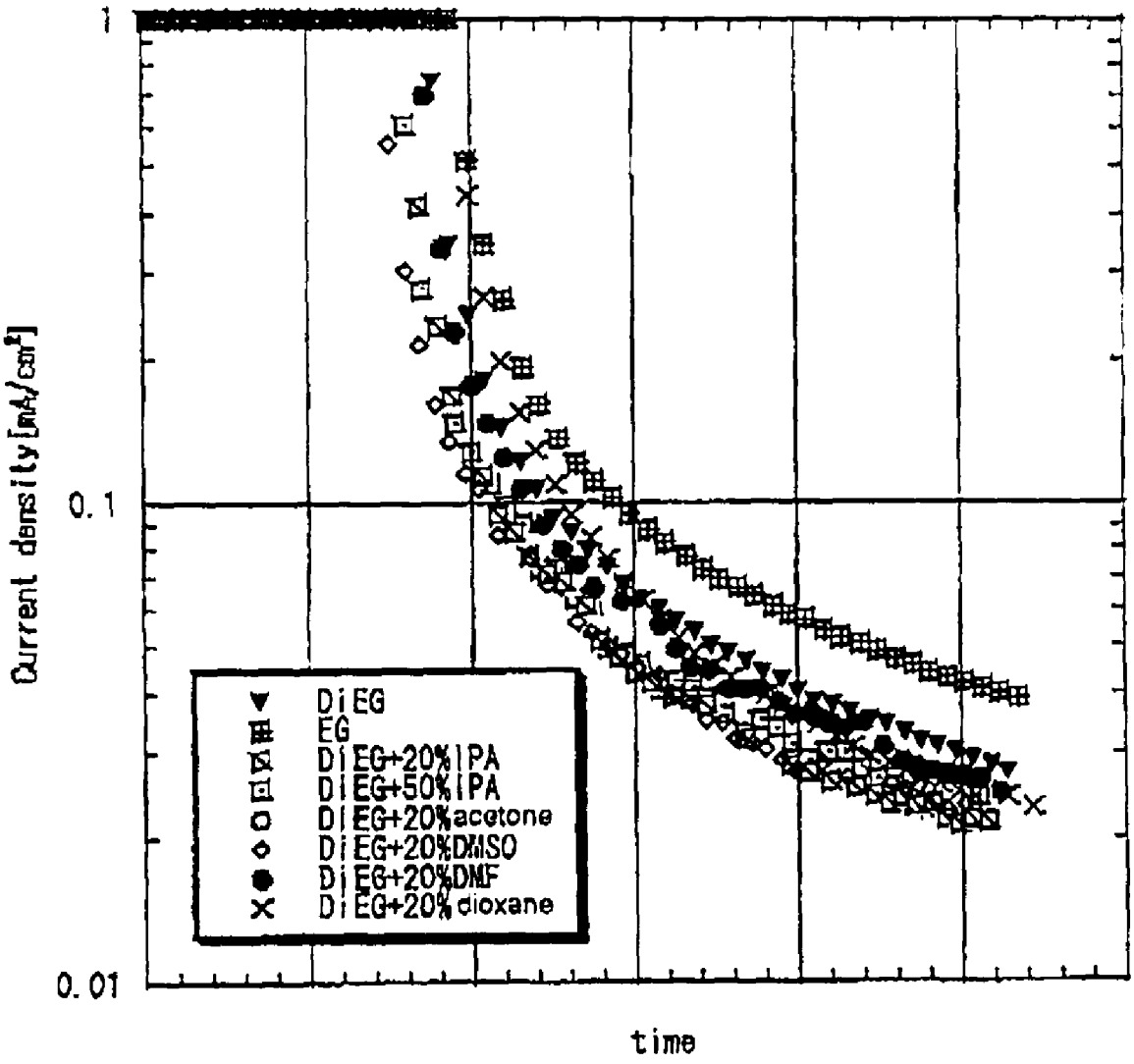
FIG. 11 is a graph showing a current characteristic with time in anodic oxidation in Example 3.

FIG. 11 shows the current characteristic with time when anodic oxidation was performed in Example 3. From the figure, it is understood that, as compared with ethylene glycol and diethylene glycol without containing the second component, the current density is quickly reduced and has a lower value in case where the organic solvent is contained as the second component.

FIG. 12 shows the residual current density for each electrolyte solution used in Example 3. The residual current density is a value after lapse of 30 minutes after a predetermined voltage is reached. For the first through the eighth electrolyte solutions from the above, numerical values are extracted from FIG. 11. For diethylene glycol without containing the second component, those cases where the anodization solution is kept at 40° C., 50° C., and 60° C. are also shown, in addition to 23° C.

Example 4

Next, the high-purity aluminum alloy same as that in Example 1 was subjected to anodic oxidation by the use of the anodization solution containing the second solvent added to the main solvent. The voltage and the current characteristics during the anodic oxidation were measured.

Figure 16:
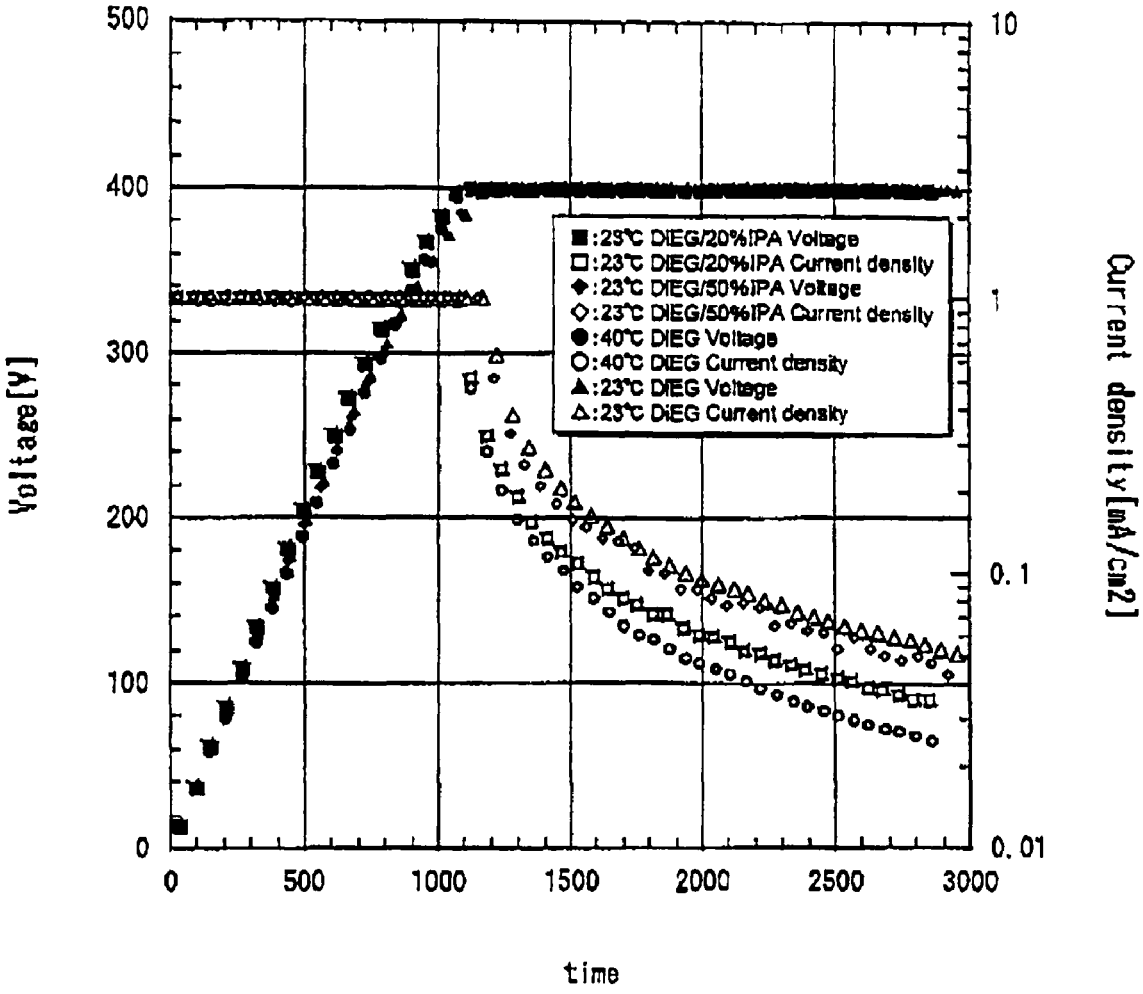
FIG. 16 is still another graph showing voltage and current characteristics with time when anodic oxidation is carried out at a reached voltage of 400 V in Example 4.

FIG. 16 shows the characteristics. Examination was made of the cases where diethylene glycol was used as the main solvent and 50% IPA and 20% IPA were added as the second solvent, respectively. For the sake of comparison, the case where the third solvent is not added, i.e., when diethylene glycol alone was used is also shown. In case of diethylene glycol alone, the case where the anodization solution temperature is 40° C. is also shown in addition to 23° C. From those experimental results, it is understood that the characteristics are more excellent when IPA is added to diethylene glycol, as compared with the cases when IPA is not added. Further, it is understood that, rather than addition of IPA, increase in temperature of the solution of diethylene glycol provides excellent linearity in constant-current anodic oxidation and excellent residual current density characteristic in constant-voltage anodic oxidation.

Example 5

Figure 17:
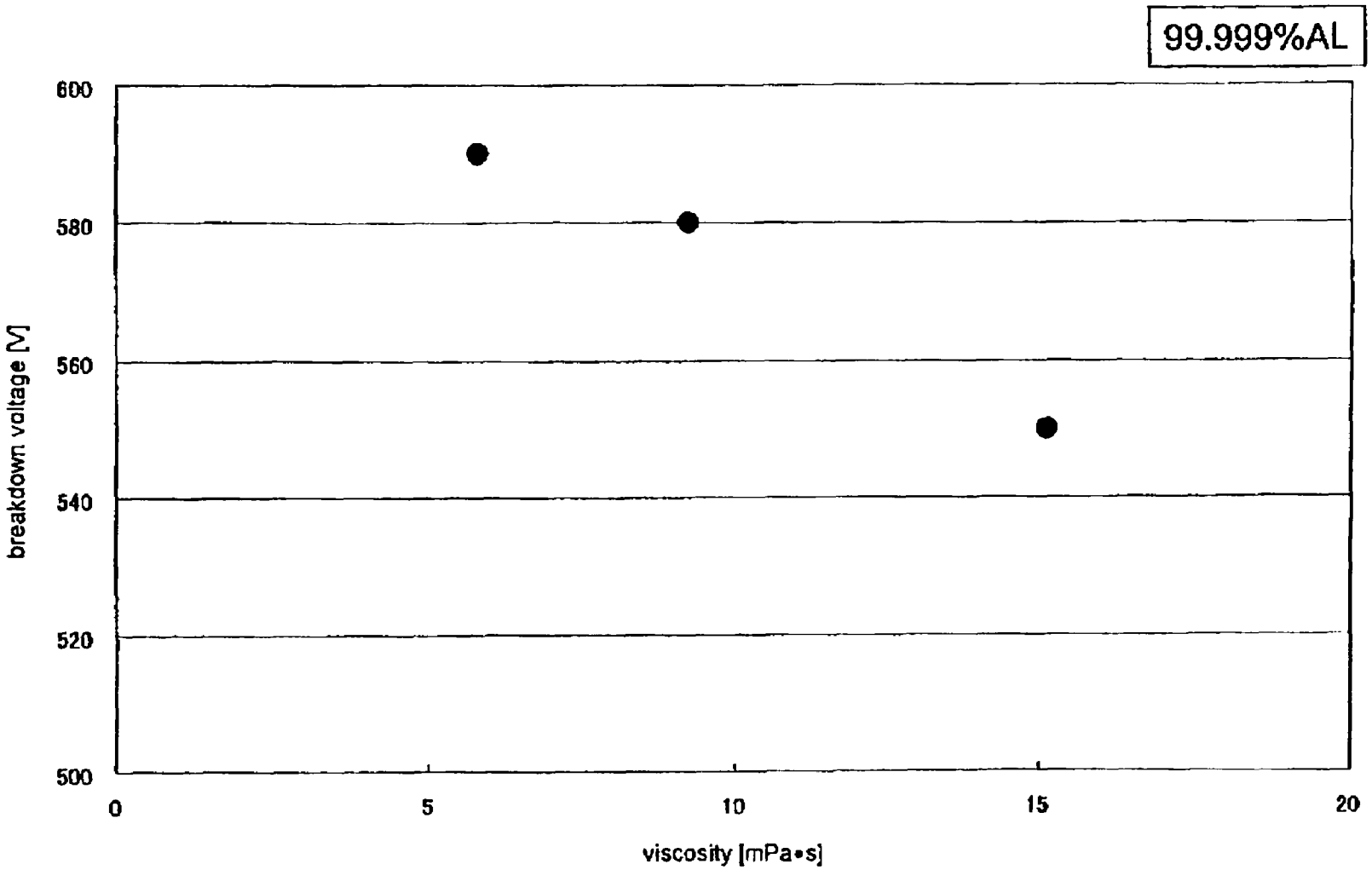
FIG. 17 is a graph showing the relationship between a viscosity of an anodization solution and a breakdown voltage of an anodized film.

In Example 5, the relationship between the viscosity of the anodization solution and the breakdown voltage was examined. For an aluminum oxide passivation film formed in a process of anodic oxidation of a 99.999% aluminum (5N—Al) substrate, the dielectric voltage was measured. If the anodization voltage during anodic oxidation can be increased, the aluminum oxide passivation film having a greater thickness can be obtained. However, as the anodization voltage is increased, the aluminum oxide film to be formed is applied with a greater voltage to cause dielectric breakdown. In FIG. 17, the viscosity of the anodization solution and the breakdown voltage of the aluminum oxide passivation film are plotted in a horizontal axis and a vertical axis, respectively. From the figure, it is understood that, when the viscosity of the anodization solution is lower, the breakdown voltage is greater.

As described above, according to this invention, it is possible to provide a metal oxide film containing aluminum as a main component, particularly a barrier-type metal oxide film without fine holes or pores, and a method of manufacturing the same. This metal oxide film and a metal member having the same exhibit excellent corrosion resistance against chemicals and halogen gases, particularly a chlorine gas. Further, since cracks hardly occur in the metal oxide film even if heated, it is possible to suppress generation of particles and corrosion due to exposure of the aluminum base body. In addition, thermal stability is high and the amount of outgas released from the film is small. If the metal oxide film is used as a protective film of a structural member such as an inner wall of a vacuum apparatus such as a vacuum thin-film forming apparatus, the ultimate vacuum of the apparatus is improved and the quality of thin films manufactured is improved, thus leading to reduction in operation failure of devices having the thin films.

Further, according to a method of manufacturing a metal oxide film according to this invention, it is possible to efficiently form a pore-free metal oxide film having a high breakdown voltage and prevented from occurrence cracks during heating. This metal oxide film is suitable as a protective coating film for the surface of a metal base member and may also be used as an impurity shielding coating film or an anticorrosive coating film. Thus, the application range is wide.

What is claimed is:

1. A method of manufacturing a metal member comprising:

(A) anodizing a metal material comprising 50 wt. % or more aluminum and 1 to 4.5 wt. % magnesium in an anodization solution having a pH of 4 to 10 and comprising a nonaqueous solvent having a dielectric constant smaller than that of water and capable of dissolving water, the nonaqueous solvent comprising at least one selected from the group consisting of diethylene glycol, triethylene glycol, and tetraethylene glycol;

(B) controlling viscosity of the anodization solution which comprises maintaining the anodization solution at a temperature within a range between 30° C. and 70° C.; and thereby forming a nonporous amorphous aluminum oxide passivation film on a surface of the metal material.

2. The method according to claim 1, wherein the controlling the viscosity (B) comprises adjusting the viscosity of the anodization solution to a range of 2 to 50 mPa·s at a temperature at which the anodization solution is maintained when anodizing.

3. The method according to claim 1, wherein the controlling the viscosity (B) comprises adjusting the viscosity of the anodization solution to a range of 2 to 10 mPa·s at a temperature at which the anodization solution is maintained when anodizing.

4. The method according to any one of claims 1 to 3, wherein the controlling the viscosity (B) comprises maintaining the anodization solution at a temperature higher than the room temperature.

5. The method according to claim 1, wherein the controlling the viscosity (B) comprises adding to the anodization solution, a substance having a dielectric constant smaller than that of water and a viscosity lower than that of the nonaqueous solvent.

6. The method according to claim 1, wherein the anodization solution comprises an electrolyte that makes the anodization solution electrically conductive, and the anodization solution has a pH of 5.5 to 8.5.

7. The method according to claim 6, wherein the anodization solution comprises 50 wt % or less water and has a pH of 6 to 8.

8. The method according to claim 6, wherein the electrolyte comprises at least one selected from the group consisting of boric acid, phosphoric acid, organic carboxylic acid, a salt of boric acid, a salt of phosphoric acid, and a salt of an organic carboxylic acid.

9. The method according to claim 6, wherein the electrolyte comprises adipate.

10. The method according to claim 1, wherein the (A) anodizing comprises:

(A1) placing the metal material and a predetermined electrode in the anodization solution;

(A2) causing a constant current to flow between the metal material and the electrode for a predetermined time; and (A3) applying a constant anodization voltage (Vf) of from 300V to 700V between the metal member and the electrode.

11. The method according to claim 10, wherein the predetermined time in the causing a constant current to flow (A2) is a time required for a voltage between the metal material and the predetermined electrode to reach a predetermined level.

12. The method according to claim 10, wherein the constant anodization voltage (A3) is applied for a time required for a current between the metal material and the predetermined electrode to reach a predetermined level.

13. The method according to claim 10, wherein a current of 0.01 to 100 mA per square centimeter is caused to flow in the causing a constant current (A2).

14. The method according to claim 13, wherein the current of 0.1 to 10 mA per square centimeter is caused to flow in the causing a constant current (A2).

15. The method according to claim 13, wherein the current of 0.15 to 1.5 mA per square centimeter is caused to flow in the causing a constant current (A2).

16. The method according to claim 10, wherein the constant anodization voltage applied in the applying a constant anodization voltage (A3) is a voltage at which electrolysis of the anodization solution does not occur.

17. The method according to claim 10, wherein the (A) anodizing comprises:

(A3) applying a constant anodization voltage (Vf) of from 300V to 500V between the metal member and the electrode at which constant anodization voltage (Vf) electrolysis of the anodization solution comprising the nonaqueous solvent does not occur.

18. A method according to claim 1, further comprising:

(C) heat-treating the metal material at a predetermined temperature not lower than 150° C. after the (A) anodizing.

19. The method according to claim 18, wherein the predetermined temperature is not lower than 300° C.

20. The method according to claim 1, wherein the metal material comprises 0.15 wt % or less zirconium.

21. The method according to claim 1, wherein the metal material is a metal in which the total content of elements other than aluminum, magnesium, and zirconium, is 1 wt % or less.

22. The method according to claim 1, wherein the metal material is a metal in which the total content of elements other than aluminum, magnesium, and zirconium, is 0.01 wt % or less.

23. The method according to claim 1, wherein the manufactured metal member is an anodized metal material has a metal oxide film formed on its surface having a thickness between 20 nm and 1.0 μm.

24. A method of manufacturing a metal member according to claim 1, comprising:

(A) anodizing a metal material comprising 50 wt. % or more aluminum and 1 to 4.5 wt. % magnesium by applying a constant anodization voltage (Vf) of from 300V to 700V between the metal material and an electrode in an anodization solution having a pH of 4 to 10 and comprising a nonaqueous solvent having a dielectric constant smaller than that of water and capable of dissolving water, the nonaqueous solvent comprising at least one selected from the group consisting of diethylene glycol, triethylene glycol, and tetraethylene glycol;

(B) controlling viscosity of the anodization solution which comprises by adjusting the viscosity of the anodization solution to a range of 2 to 50 mPa·s at a temperature at which the anodization solution is maintained when anodizing and maintaining the anodization solution at a temperature within a range between 30° C. and 70° C.; and thereby forming a nonporous amorphous aluminum oxide passivation film on a surface of the metal material.

* * * * *